US010479587B2

(12) United States Patent
Mizoguchi et al.

(10) Patent No.: US 10,479,587 B2
(45) Date of Patent: Nov. 19, 2019

(54) CARTRIDGE FOR VISCOUS-MATERIAL DISPENSER

(71) Applicant: KAGA WORKS CO., LTD., Nagoya-shi (JP)

(72) Inventors: Osamu Mizoguchi, Nagoya (JP); Hitoshi Tsujikawa, Nagoya (JP); Kyota Imai, Nagoya (JP); Akira Kanazawa, Kasugai (JP)

(73) Assignee: KAGA WORKS CO., LTD., Nagoya-Shi (JP)

( * ) Notice: Subject to any disclaimer, the term of this patent is extended or adjusted under 35 U.S.C. 154(b) by 4 days.

(21) Appl. No.: 15/504,720

(22) PCT Filed: Aug. 21, 2015

(86) PCT No.: PCT/JP2015/073548
§ 371 (c)(1),
(2) Date: Jun. 8, 2017

(87) PCT Pub. No.: WO2016/031722
PCT Pub. Date: Mar. 3, 2016

(65) Prior Publication Data

US 2017/0275079 A1 Sep. 28, 2017

(30) Foreign Application Priority Data

Aug. 25, 2014 (JP) ..... 2014-170672

(51) Int. Cl.
*B65D 83/00* (2006.01)
*B05C 17/015* (2006.01)
(Continued)

(52) U.S. Cl.
CPC .... *B65D 83/0005* (2013.01); *B05C 17/00516* (2013.01); *B65D 83/425* (2013.01)

(58) Field of Classification Search
CPC ..... B65D 83/0005; B65D 83/425; B05C 17/00516; B05C 17/00579; B05C 17/015; B65B 3/12; B65B 43/54
(Continued)

(56) References Cited

U.S. PATENT DOCUMENTS 3,099,370 A * 7/1963 Hein ..... B65D 83/646 222/386.5
4,704,105 A 11/1987 Adorjan et al.
(Continued)

FOREIGN PATENT DOCUMENTS

DE 3718948 A1 12/1988
EP 0900599 A2 3/1999
(Continued)

OTHER PUBLICATIONS

Un-published U.S. Appl. No. 15/768,959.
(Continued)

*Primary Examiner* — Benjamin R Shaw
(74) *Attorney, Agent, or Firm* — J-Tek Law PLLC; Jeffrey D. Tekanic; Scott T. Wakeman

(57) ABSTRACT

A cartridge (12) for a viscous-material dispenser includes a plunger (10) that is slidable within a cylinder (18). A seal body (104) forms between an outer circumferential surface (82) of the plunger and an inner circumferential surface (84) of the cylinder when a viscous material flows into a radial tubular clearance (106) that continuously extends both axially and circumferentially between the outer circumferential surface and the inner circumferential surface. Ridges (100) may be formed on the outer circumferential surface of the plunger to guide the inflowing viscous material and facilitate the formation of the seal body.

18 Claims, 13 Drawing Sheets

(51) Int. Cl.

| | |
|---|---|
| ***B65B 43/54*** | (2006.01) |
| ***B65B 3/12*** | (2006.01) |
| ***B05C 17/005*** | (2006.01) |
| ***B65D 83/42*** | (2006.01) |

(58) Field of Classification Search
USPC ..... 222/386.5
See application file for complete search history.

(56) References Cited

U.S. PATENT DOCUMENTS

| | | | | |
|---|---|---|---|---|
| 4,840,293 | A | 6/1989 | Segatz | |
| 4,854,485 | A | 8/1989 | Collins | |
| 4,986,444 | A | 1/1991 | Corso | |
| 5,242,091 | A | 9/1993 | Ishida et al. | |
| 5,360,146 | A * | 11/1994 | Ikushima | B05C 17/00576 222/326 |
| 5,547,107 | A | 8/1996 | Boiardi | |
| 5,680,967 | A * | 10/1997 | Dang | B65D 83/0005 222/327 |
| 5,718,357 | A * | 2/1998 | Dang | B05C 17/00576 222/153.06 |
| 6,308,868 | B1 | 10/2001 | Hoffman et al. | |
| 6,334,553 | B1 * | 1/2002 | Bouras | B05C 11/10 222/386 |
| 6,655,555 | B1 | 12/2003 | Yankoglu et al. | |
| 6,681,810 | B2 | 1/2004 | Weston | |
| 7,458,487 | B1 | 12/2008 | Ikushima | |
| 7,878,377 | B2 | 2/2011 | Ikushima | |
| 9,126,702 | B2 | 9/2015 | Mizoguchi et al. | |
| 9,340,306 | B2 | 5/2016 | Mizoguchi et al. | |
| 9,598,223 | B2 | 3/2017 | Mizoguchi et al. | |
| 10,293,361 | B2 | 5/2019 | Mizoguchi et al. | |
| 2004/0007598 | A1 | 1/2004 | Barrett | |
| 2006/0043120 | A1 * | 3/2006 | Campbell | B05C 17/0146 222/386.5 |
| 2009/0026226 | A1 | 1/2009 | Ikushima | |
| 2009/0198182 | A1 | 8/2009 | Fujishima et al. | |
| 2009/0272767 | A1 | 11/2009 | Herman et al. | |
| 2010/0147896 | A1 | 6/2010 | Obrist | |
| 2011/0254187 | A1 | 10/2011 | Mizoguchi et al. | |
| 2012/0205001 | A1 | 8/2012 | Mizoguchi et al. | |
| 2014/0084022 | A1 | 3/2014 | Paul et al. | |
| 2015/0069091 | A1 | 3/2015 | Mizoguchi et al. | |
| 2015/0336690 | A1 | 11/2015 | Mizoguchi et al. | |
| 2016/0221696 | A1 | 8/2016 | Mizoguchi et al. | |
| 2018/0297054 | A1 | 10/2018 | Mizoguchi et al. | |
| 2019/0232331 | A1 | 8/2019 | Mizoguchi et al. | |

FOREIGN PATENT DOCUMENTS

| | | | |
|---|---|---|---|
| EP | 1270412 | B1 | 9/2005 |
| EP | 2108599 | A1 | 10/2009 |
| FR | 1228986 | A | 9/1960 |
| FR | 2259960 | A1 | 8/1975 |
| GB | 2071268 | A | 9/1981 |
| JP | S5766679 | U | 4/1982 |
| JP | S58981 | U | 1/1983 |
| JP | S60500045 | A | 1/1985 |
| JP | S6058281 | U | 4/1985 |
| JP | S61171565 | A | 8/1986 |
| JP | S6333202 | A | 2/1988 |
| JP | S63176576 | U | 11/1988 |
| JP | H0295571 | U | 7/1990 |
| JP | H0490868 | A | 3/1992 |
| JP | H04200672 | A | 7/1992 |
| JP | H0557870 | A | 3/1993 |
| JP | H05147677 | A | 6/1993 |
| JP | H05200343 | A | 8/1993 |
| JP | H05254580 | A | 10/1993 |
| JP | H0642800 | U | 6/1994 |
| JP | H06283856 | A | 10/1994 |
| JP | H07106331 | B2 | 11/1995 |
| JP | H11104404 | A | 4/1999 |
| JP | 2000507535 | A | 6/2000 |
| JP | 3073311 | U | 11/2000 |
| JP | 2000317370 | | 11/2000 |
| JP | 2000344282 | A | 12/2000 |
| JP | 2002080005 | A | 3/2002 |
| JP | 2003054694 | A | 2/2003 |
| JP | 2004037935 | A | 2/2004 |
| JP | 2004321985 | A | 11/2004 |
| JP | 2007176536 | A | 7/2007 |
| JP | 2010042361 | A | 2/2010 |
| JP | 2010164196 | A | 7/2010 |
| JP | 4659128 | B1 | 3/2011 |
| JP | 5101743 | B1 | 12/2012 |
| JP | 2013212466 | A | 10/2013 |
| JP | 2013212878 | A | 10/2013 |
| JP | 5651803 | B1 | 1/2015 |
| WO | 9849994 | A | 11/1998 |
| WO | 2013/150683 | A1 | 10/2013 |
| WO | 2017069082 | A1 | 4/2017 |

OTHER PUBLICATIONS

Supplemental European Search Report dated Jul. 19, 2017 in related EP application No. 15 836 747.4, including European Search Opinion, European Search Report and examined claims 1-16.

English translation of International Search Report dated Nov. 2, 2015 for parent application No. PCT/JP2015/073548.

English translation of Written Opinion of the International Searching Authority dated Nov. 2, 2015 for parent application No. PCT/JP2015/073548.

Office Action from the Japanese Patent Office dated Nov. 20, 2018 in counterpart Japanese application No. 2018-001568, and machine translation thereof.

Search Report from the Japanese Patent Office dated Nov. 9, 2018 in counterpart Japanese application No. 2018-001568, and machine translation thereof.

Extended European Search Report dated May 24, 2019 in related application EP 15836747, including Search Opinion, Supplementary European Search Report and examined claims 1-16.

Extended European Search Report dated May 24, 2019 in related application EP 16857397, including Search Opinion, Supplementary European Search Report and examined claims 1-9.

Office Action from the Japanese Patent Office dated Aug. 6, 2019 in related Japanese application No. 2016-160533, and machine translation thereof.

Machine Translation of Search Report from the Japanese Patent Office dated Jul. 25, 2019 in related Japanese application No. 2016-160533.

* cited by examiner

| | | |
|---|---|---|
| S1 | PREPARE VISCOUS MATERIAL | |
| | S11 | MIX |
| | S12 | AGITATE AND DEGAS |
| S2 | FILL WITH VISCOUS MATERIAL | |
| | S21 | PREPARE CONTAINER SET |
| | S22 | HOLD CONTAINER SET |
| | S23 | PREPARE CARTRIDGE |
| | S24 | HOLD CARTRIDGE |
| | S25 | INSERT ROD |
| | S26 | EXTRUDE |
| | S27 | ASSIST UPWARD DISPLACEMENT OF ROD |
| | S28 | RETRACT ROD |
| | S29 | REMOVE CARTRIDGE |
| | S30 | REMOVE CONTAINER SET |

FIG.11

CARTRIDGE FOR VISCOUS-MATERIAL DISPENSER

CROSS-REFERENCE

This application is the US national stage of International Patent Application No. PCT/JP2015/073548 filed on Aug. 21, 2015, which claims priority to Japanese Patent Application No. 2014-170672 filed on Aug. 25, 2014.

TECHNICAL FIELD

The invention relates to plungers that are used by being fitted into a cylinder of a pneumatic dispenser that discharges a viscous material by using pressurized gas.

BACKGROUND ART

Fields are already known that deal with viscous materials. Such applications include sealants for mechanical or electrical components, encapsulants, coating agents, grease, resin compositions (e.g., epoxy resins), adhesives, pastes for use in forming electrical or electronic circuits, solders for use in mounting electronic components, etc. Such viscous materials are used in the aerospace industry, the electrical industry, the electronics industry, etc.

In order to apply a viscous material to a desired target, a pneumatic dispenser is used that discharges the viscous material by using pressurized gas. In this type of pneumatic dispenser, a plunger or a piston is fitted in a cylinder. As a result of the fitting, an inner chamber of the cylinder is divided into a filling chamber, into which the viscous material is filled from outside of the filling chamber, and a pressurizing chamber into which the pressurized gas is introduced.

In order to discharge the viscous material towards a desired target using a pneumatic dispenser of this type, it is first necessary to fill the filling chamber in the cylinder of the pneumatic dispenser with the viscous material. Following the filling, the viscous material is discharged towards the desired target by applying pressure to the plunger in the pneumatic dispenser using the pressurized gas in the pressurizing chamber.

The co-inventors repeatedly performed experiments in which a viscous material is filled into a conventional cartridge assembled by fitting a conventional plunger in a cylinder, and after completion of the filling, the cartridge is attached to a pneumatic dispenser and the viscous material is discharged from the pneumatic dispenser.

As a result, the co-inventors obtained the following insights. That is, in the filling stage, it is important to simultaneously fulfill: the need (intended air venting or degassing of the viscous material) to vent air, which is present in a filling chamber, by passing it through a clearance between the plunger and the cylinder, and the need (viscous material leakage prevention) to create, after completion of the air venting, a seal between the plunger and the cylinder, to thereby prevent the viscous material from leaking from the filling chamber into the pressurizing chamber.

In addition, in the discharging stage, it is important to create a seal between the plunger and the cylinder, to thereby prevent the ingress of the pressurized gas from the pressurizing chamber into the filling chamber (pressurized air leakage prevention). An unintended leakage of the pressurized gas from the pressurizing chamber into the filling chamber could cause a problem that the pneumatic dispenser fails to expel the viscous material properly, and a problem that the pressurized gas unintentionally enters the filling chamber, in which the viscous material is stored as a material to be expelled next, and gas bubbles are entrapped in the viscous material within the filling chamber.

To achieve the demands described above, the co-inventors developed a new plunger. This plunger is disclosed in Patent Document No. 1.

More specifically, at least two lands are formed on an outer circumferential surface of this plunger such that each land extends circumferentially. These lands include a first land proximal to the filling chamber, and a second land proximal to the pressurizing chamber. Since the second land is larger in diameter than the first land, a radial clearance created between the top surface of the second land and an inner circumferential surface of a cylinder is smaller than that created between the top surface of the first land and the inner circumferential surface of the cylinder.

This plunger is fitted within the cylinder to provide a cartridge for a pneumatic dispenser; when the cartridge undergoes the filling stage, initially, air within the filling chamber is vented to the pressurizing chamber through clearances between the first land and the cylinder and between the second land and the cylinder.

Upon completion of the air venting (i.e., degassing of the viscous material), a portion of the viscous material within the filling chamber passes through a radial clearance between the plunger and the cylinder upstream of the first land, and reaches the first land, thereby completing the creation of a first seal between the first land and the cylinder. In other words, a portion of the viscous material that is to be used for the filling forms the first seal.

With time, another portion of the viscous material reaches the second land, thereby creating a second seal between the second land and the cylinder. In other words, another portion of the viscous material that is to be used for the filling forms the second seal. In the filling stage, after the first and second seals are completed, the viscous material is prevented from leaking from the filling chamber to the pressurizing chamber.

In the ensuing discharging stage, from its beginning, both the first and second seals are completed. As a result, pressurized gas, once introduced into the pressurizing chamber, is blocked by the second seal. This prevents the pressurized gas from leaking from the pressurizing chamber into the filling chamber.

PRIOR ART REFERENCE

Patent Document

Patent Document No. 1: Japanese Patent No. 5101743

SUMMARY OF THE INVENTION

The co-inventors repeatedly performed experiments using that plunger, and as a result, the co-inventors obtained the following insights.

That is, in the discharging stage of this plunger, pressurized gas from the outside is introduced into the pressurizing chamber located behind the plunger. As a result, the rear pressure on the plunger rapidly increases relative to the pressure of the filling chamber, and a thrust force on the plunger arises. Owing to this thrust force, the plunger advances towards the filling chamber, and as a result, the viscous material is discharged from the filling chamber to the outside.

Ideally, it is important to apply the pressurized gas to the plunger so that the rear pressure is generated and applied to the plunger without producing any moment, i.e., a tilting moment, in a direction that causes the plunger to tilt relative to the cylinder.

The reason is that, if such a tilting moment occurs, the plunger tilts relative to the cylinder, resulting in a tendency in which, in one region of the plunger, the plunger moves radially outwardly and strongly pushes against the inner circumferential surface of the cylinder, while, in another region of the plunger, the plunger moves radially inwardly and separates from the inner circumferential surface of the cylinder.

When the plunger locally separates from the inner circumferential surface of the cylinder, the radial clearance between the plunger and the cylinder locally enlarges, and gaps are locally generated in the viscous material that fills this enlarged portion. When the pressurized gas from the pressurizing chamber enters into these gaps, the gaps are stretched longitudinally and, in the worst case, this induces unexpected passages, which cause the pressurizing chamber to communicate with the filling chamber, to form. These passages cause the pressurized gas to be unintentionally introduced into the viscous material that has filled into the filling chamber and that is about to be discharged, and as a result, gas bubbles are entrapped in the viscous material.

However, practically, it is impossible to operate the plunger such that the rear pressure acts on the plunger while absolutely no such tilting moment occurs on the plunger.

Based upon the above-described insights, the invention has been created for the purpose of providing a plunger for use by being fitted in a cylinder of a pneumatic dispenser that discharges a viscous material by using pressurized air that, in the discharging stage of the viscous material from the pneumatic dispenser, eliminates or reduces the tendency of the plunger to unintentionally tilt relative to the cylinder, thereby eliminating or reducing the possibility that unintended tilting causes gas bubbles to be entrapped in the viscous material within the filling chamber.

According to the present invention, the following modes are provided. These modes will be stated below such that these modes are divided into sections and are numbered, and such that these modes depend upon other mode(s), where appropriate. This facilitates a better understanding of some of the plurality of technical features and the plurality of combinations thereof disclosed in this specification, and does not mean that the scope of these features and combinations should be interpreted to limit the scope of the following modes of the invention. That is to say, it should be interpreted that it is allowable to select the technical features, which are stated in this specification but which are not stated in the following modes, as technical features of the invention.

Furthermore, reciting herein each one of the selected modes of the invention in a dependent form so as to depend from the other mode(s) does not exclude the possibility of the technical features in the dependent-form mode from becoming independent of those in the corresponding dependent mode(s) and to be removed therefrom. It should be interpreted that the technical features in the dependent-form mode(s) may become independent according to the nature of the corresponding technical features, where appropriate.

(1) A plunger for use by being fitted into a cylinder of a pneumatic dispenser that discharges a viscous material by using pressurized air, wherein an inner chamber of the cylinder is divided by the fitting of the plunger therein into a filling chamber into which the viscous material is filled from the outside and a pressurizing chamber into which the pressurized air is charged from the outside, the plunger comprising:

a cylindrical main body portion that axially extends and has an outer circumferential surface; and a seal formed between the outer circumferential surface and an inner circumferential surface of the cylinder, in a fitted state in which the plunger is fitted within the cylinder, wherein the outer circumferential surface, in the fitted state, substantially circumferentially forms a radial clearance between the outer circumferential surface and the inner circumferential surface, thereby forming a tubular clearance, which serves as a continuous clearance, between the outer circumferential surface and the inner circumferential surface such that the tubular clearance continuously extends both in axial and circumferential directions, and when the viscous material is filled into the filling chamber from the outside, the continuous clearance is filled with a portion of the viscous material, thereby forming the seal, wherein said portion of the viscous material blocks the rest of the viscous material from leaking from the filling chamber into the pressurizing chamber.

(2) The plunger for pneumatic dispenser according to (1), wherein the dimensions of the radial clearance are set to vary between a lower limit, which is necessary to allow the plunger to be fitted into the cylinder in an axially slidable manner without substantial play, and an upper limit, which is necessary, in a substantially final stage of a discharging phase in which the viscous material is discharged from the filling chamber to the outside, to allow the continuous clearance to be substantially entirely filled with a portion of the viscous material both in the circumferential and axial directions of the continuous clearance.

(3) A plunger for use by being fitted into a cylinder of a pneumatic dispenser that discharges a viscous material by using pressurized air, wherein an inner chamber of the cylinder is divided by the fitting of the plunger therein into a filling chamber into which the viscous material is filled from the outside and a pressurizing chamber into which the pressurized air is charged from the outside, the plunger comprising:

a cylindrical main body portion that axially extends and has an outer circumferential surface; and a seal formed with at least one ridge that generally axially extends on the outer circumferential surface, such that, in case this ridge is a plurality of ridges, these ridges are spaced apart from each other in the circumferential direction, and the seal seals a space between the outer circumferential surface and an inner circumferential surface of the cylinder in a fitted state in which the plunger is fitted within the cylinder, wherein the outer circumferential surface, in a coaxially fitted state in which the plunger is coaxially fitted into the cylinder, substantially circumferentially forms a radial clearance between the outer circumferential surface and the inner circumferential surface, thereby forming a tubular clearance, which serves as a continuous clearance, between the outer circumferential surface and the inner circumferential surface such that the tubular clearance continuously extends both in axial and circumferential directions, and when the viscous material is filled into the filling chamber from the outside, the continuous clearance is filled with a portion of the viscous material, thereby forming the seal, wherein said portion of the viscous material blocks the rest of the viscous material from leaking from the filling chamber into the pressurizing chamber.

(4) The plunger for pneumatic dispenser according to (3), wherein, in a filling phase in which the viscous material is filled into the filling chamber from the outside, a portion of the viscous material travels from the filling chamber into the continuous clearance, thereby filling the continuous clearance with said portion of the viscous material that serves as a fill viscous-material, in the filled state, the fluidity of the fill viscous-material within the continuous clearance varies such that the fluidity is higher in the axial direction than in the circumferential direction, and the fill viscous-material is allowed to flow between a ridge region on the outer circumferential surface that is defined by the ridge, and a groove region on the outer circumferential surface that is not defined by the ridge, thereby facilitating the filling of the continuous clearance with the fill viscous-material both in the axial and circumferential directions, in a fully-filled state in which the continuous clearance is fully filled with the fill viscous-material, the fill viscous-material itself blocks the rest of the viscous material from leaking into the pressuring chamber, in a pre-fully-filled state prior to the fully-filled state, unwanted gasses unwantedly existing in the filling chamber are allowed to vent, via a portion of the continuous clearance that has not yet filled with the fill viscous-material, into the pressurizing chamber, and in a discharging phase in which, in the fully-filled state, the pressurized gas is introduced into the pressurizing chamber to discharge the viscous material from the filling chamber, the fill viscous-material blocks the pressurizing gas from leaking from the pressurizing chamber into the filling chamber.

(5) The plunger for pneumatic dispenser according to (3) or (4), wherein the plunger is elastically deformable at the at least one ridge in a radial direction of the plunger, thereby allowing the ridge, when a tip end of the ridge is brought into contact with the inner circumferential surface, to be elastically deformed radially inwardly to prevent the ridge from strongly contacting the inner circumferential surface.

(6) The plunger for pneumatic dispenser according to anyone of (3)-(5), wherein each ridge has a width dimension narrower than that of a groove that is located on the outer circumferential surface and is adjacent to the ridge.

(7) The plunger for pneumatic dispenser according to any one of (3)-(6), wherein at least one of the at least one ridge extends substantially entirely along the length of the plunger.

(8) The plunger for pneumatic dispenser according to any one of (3)-(7), wherein at least one of the at least one ridge has a width dimension that increases in the direction from the filling chamber to the pressurizing chamber.

(9) The plunger for pneumatic dispenser according to any one of (3)-(8), wherein at least one of the at least one ridge has a height dimension that increases in the direction from the filling chamber to the pressurizing chamber.

(10) The plunger for pneumatic dispenser according to any one of (3)-(9), wherein at least one of the at least one ridge is configured as multiple ridge segments that are aligned and spaced apart from each other in the axial direction.

(11) The plunger for pneumatic dispenser according to any one of (3)-(10), wherein the outer circumferential surface is a smooth surface that substantially does not have any unevenness, or is an uneven surface.

(12) The plunger for pneumatic dispenser according to any one of (3)-(11), wherein the length dimension of the plunger is greater than its diameter dimension.

(13) A set comprising the plunger according to any one of (1)-(12) and the cylinder according to any one of (1)-(12).

(14) The plunger for pneumatic dispenser according to any one of (1)-(12), wherein the inner outline of the shape, which represents the cross section of the inner circumferential surface, is a circle, and the outer outline of the shape, which represents the cross section of the outer circumferential surface, is a smaller circle than the above-mentioned circle.

(15) The plunger for pneumatic dispenser according to any one of (1)-(12), wherein the inner outline of the shape, which represents the cross section of the inner circumferential surface is a circle, and the outer outline of the shape, which represents the cross section of the outer circumferential surface, is a non-circular endless line that circumscribes a smaller circle than the above-mentioned circle.

According to the invention, when the plunger is fitted into the cylinder, a clearance continuously extending both circumferentially and axially (hereinafter, referred to as "continuous clearance") will be formed between the outer circumferential surface of the plunger and the inner circumferential surface of the cylinder.

In the state that this continuous clearance has formed, when a viscous material is filled into the filling chamber of the cylinder from the outside, the continuous clearance is entirely filled with a portion of the viscous material. The continuous clearance, which has been filled with said portion of the viscous material, functions as a seal overall, and at this time, a portion of the viscous material, which is a filler, forms this seal.

As a result, according to the invention, in the filling phase of the viscous material into the cylinder, prior to completion of the seal, intentional venting (i.e., degassing of the viscous material) can be achieved, while, after the completion of the seal, unintentional leakage of the viscous material can be prevented; furthermore, in the discharge phase of the viscous material, unintentional leakage of pressurized air is prevented throughout this entire stage.

Furthermore, according to the invention, the continuous clearance is formed between the outer circumferential surface of the plunger and the inner circumferential surface of the cylinder, thereby reducing the outer diameter of the outer circumferential surface relative to the inner diameter of the inner circumferential surface by a larger ratio than in cases in which the above-described circumferential lands are used.

As a result, simultaneously contactable regions of the outer circumferential surface of the plunger, for which there is a possibility of simultaneously contacting with the inner circumferential surface of the cylinder at each moment of time (e.g., the total area of the simultaneously contactable regions over the total length of the outer circumferential surface, or otherwise the total circumferential length of a curve obtained by virtually transversely cutting the simultaneously contactable regions of the outer circumferential surface at a particular axial position), decrease more than in cases in which the above-described circumferential lands are used.

The reduction of the simultaneously contactable regions allows the resistance to axially sliding movements of the plunger relative to the cylinder to decrease more than in cases in which the above-described circumferential lands are used. Thereby, in the discharging phase of the viscous material from a pneumatic dispenser, the plunger is caused to slide more smoothly when actuated by the pressurized gas than in cases in which the above-described circumferential lands are used.

As a result, even if the aforementioned tilting moment unintentionally occurs on the plunger when the pressurized gas acts on the plunger, the plunger tilts relative to the cylinder, and the plunger locally contacts the cylinder, the risk of the plunger being stuck at the same axial position is reduced. That is, the phenomenon of the plunger being unintentionally stuck in the cylinder due to tilting of the plunger is prevented.

When the adherence of the plunger is prevented, an excessive rise in the rear pressure on the plunger is prevented, the occurrence of a larger tilting moment is prevented, the plunger is prevented from tilting relative to the cylinder largely, and the plunger is prevented from strongly contacting the cylinder in a local manner.

As a result, in the discharging phase of the viscous material from the pneumatic dispenser, gaps in the completed seal due to tilting of the plunger are prevented from occurring. When the occurrence of such gaps is prevented, the pressurized gas is prevented from leaking from the pressurizing chamber into the filling chamber.

Because of the foregoing, according to the invention, in the discharging phase of the viscous material from the pneumatic dispenser, unintentional tilting of the plunger relative to the cylinder is prevented, thereby eliminating or reducing the risk of bubbles being entrapped in the viscous material within the filling chamber due to the unintentional tilting.

BRIEF DESCRIPTION OF THE DRAWINGS

FIG. 11 is a process flowchart illustrating the filling method, along with a viscous-material preparation method performed prior to the filling method.

EMBODIMENTS FOR CARRYING OUT THE INVENTION

Some of the more specific and illustrative embodiments of the invention will be described in the following in more detail with reference to the drawings.

Figure 1:
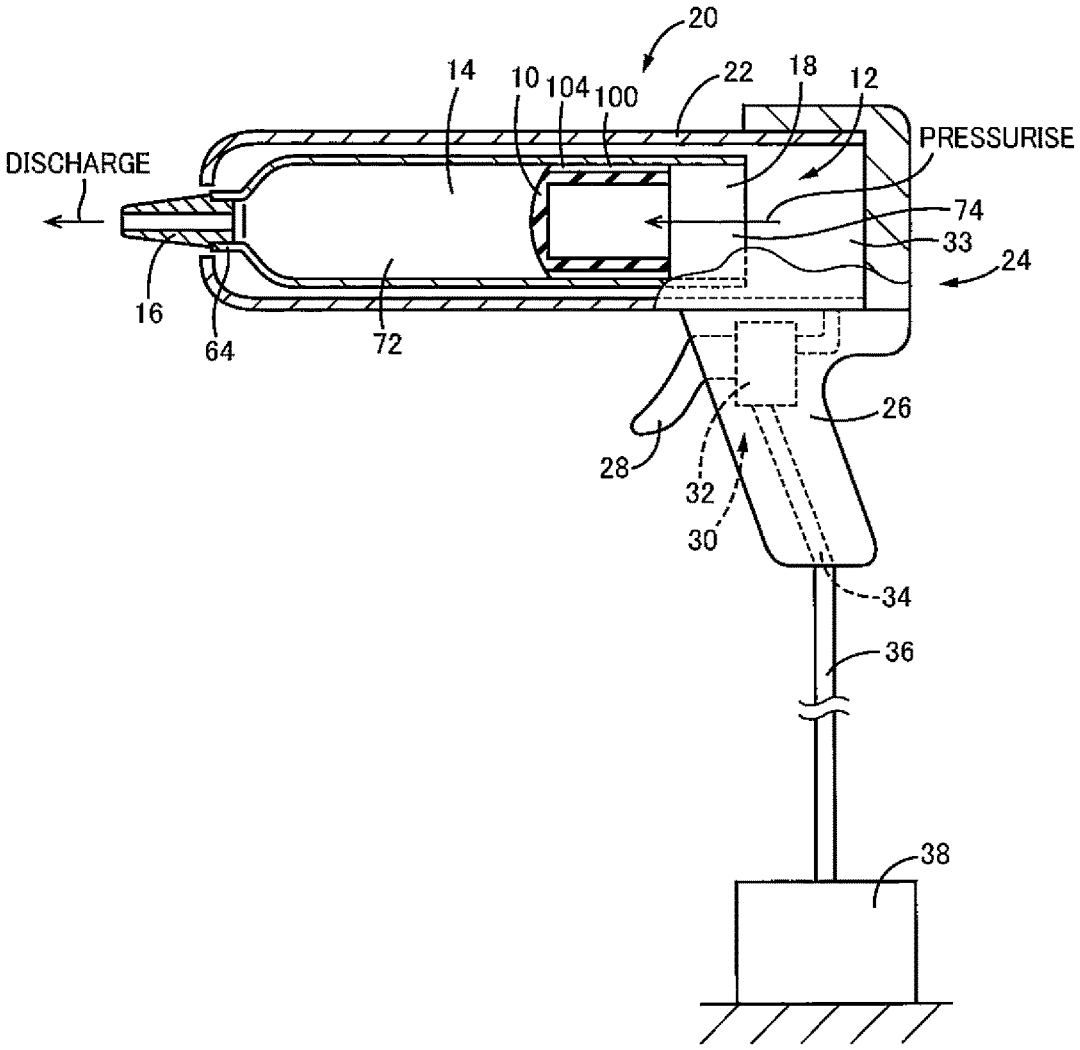
FIG. 1 is a cutaway cross-sectional side view illustrating a cartridge using a plunger according to an illustrative first embodiment of the invention, in the state that the cartridge is loaded in a pneumatic dispenser.

Referring to FIG. 1, a cartridge 12 is illustrated in a cutaway cross-sectional side view, which is constructed by fitting a plunger 10 according to an illustrative first embodiment of the invention in a cylinder 18. The cartridge 12 is illustrated in a state (an assembled state and an active state) in which the cylinder 18 has been pre-filled with a viscous material 14, a discharge nozzle 16 is detachably attached to the distal tip end of the cylinder 18, and the cartridge 12 is detachably loaded in a hand-held dispenser 20 (it is possible to be of a gun type depicted in FIG. 1 or of a not-shown straight type).

Describing first the dispenser 20, as illustrated in FIG. 1, the dispenser 20 has a cylindrical retainer 22 and a main body 24 that is detachably attached to the retainer 22. The main body 24 has a handle 26, which can be griped by an operator, and a trigger 28 (an example of a manipulation element in the form of any of a lever, a switch, a button, or the like) that is attached so as to be movable relative to the handle 26.

The main body 24 further has an air-pressure control unit 30. The air-pressure control unit 30 has a valve 32 operated by the trigger 28; the valve 32 selectively and fluidly connects a chamber 33 located behind the plunger 10 with a hose connection port 34. A high-pressure source 38 that supplies pressurized gas is coupled to the hose connection port 34 via a flexible hose 36.

When the trigger 28 is pulled by the operator, the valve 32 shifts from a closed position to an open position, thereby allowing the pressurized gas to enter the chamber (pressurizing chamber) 33 through the valve 32. When the pressurized gas impinges against the rear of the plunger 10, the plunger 10 advances relative to the cylinder 18 (in FIG. 1, is moved leftwards), thereby discharging the viscous material 14 from the cylinder 18. An example of the viscous material 14 is a high-viscosity, electrically non-conductive sealant; an example of the application of such a sealant is seals of aircraft components.

Figure 2:
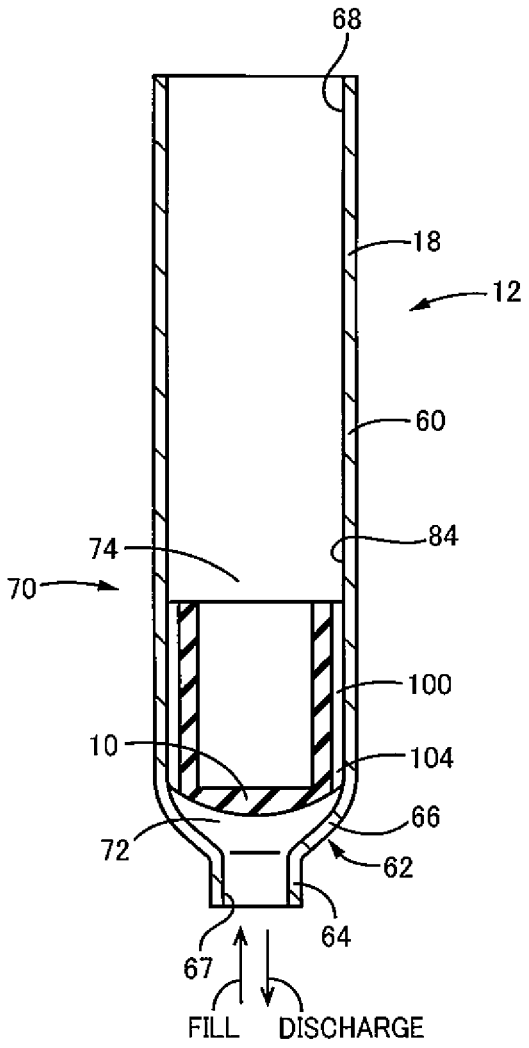
FIG. 2 is a cross-sectional side view illustrating the cartridge depicted in FIG. 1.

Next, describing the cartridge 12 schematically, as illustrated in the cross-sectional side view of FIG. 2, the cartridge 12 is configured by fitting the plunger 10 in the cylinder 18. As the material of the plunger 10, it is possible to select PE (polyethylene), PP (polypropylene), etc., to select a synthetic resin having a nearly equivalent elasticity as these, to select a synthetic resin having a higher elasticity than these, to select a synthetic resin having a lower elasticity than these, or to select a synthetic rubber (e.g., NBR). Materials known as synthetic rubbers are less stiff and instead are more elastic than synthetic resins such as PE, PP, etc.

Describing next the cylinder 18 in more detail, the cylinder 18 has a cylindrical inner chamber 70, within which the plunger 10 is detachably fitted in a substantially air-tight and axially slidable manner.

More specifically, the cylinder 18 has a tubular main body portion 60 extending straight in a uniform cross-section, and a hollow base portion 62 coupled to one of the two ends of the main body portion 60, in a coaxial alignment with respect to each other. At its tip end, the base portion 62 has a tubular portion 64 that is smaller in diameter than the main body portion 60, and the base portion 62 has a tapered portion 66 at the connection side with the main body portion 60. A through-hole in the tubular portion 64 forms a discharge port 67 of the cylinder 18, which is detachably attached to a discharge nozzle 16 (e.g., via a threaded connection), as illustrated in FIG. 1. The opposite end of the main body portion 60 is an opening 68. One example of the material constituting the cylinder 18 is PP (polypropylene), but it is not limited to this.

In the present embodiment, the viscous material 14 is filled from the outside (a container 112 depicted in FIG. 7) into the cartridge 12 by passing through the discharge port 67 of the cartridge 12; after completion of the filling, the viscous material 14 is discharged from the cartridge 12 to dispense the viscous material 14 for use by passing through the same passage, i.e., a passage within the discharge port 67 (the smallest-diameter passage of the cylinder 18). In other words, the flow of the viscous material 14 into and out of the cartridge 12 is carried out by passing through the discharge port 67, which is the smallest-diameter passage.

As illustrated in FIG. 2, the inner chamber 70 of the cylinder 18 is divided by the plunger 10, into a filling chamber 72 that stores the viscous material 14 and a pressurizing chamber 74 into which the pressurized gas is introduced, both of which are coaxially aligned. The filling chamber 72 is in communication with the discharge port 67, while the pressurizing chamber 74 is connected to the high-pressure source 38 via the valve 32, as illustrated in FIG. 1.

Figure 3A:
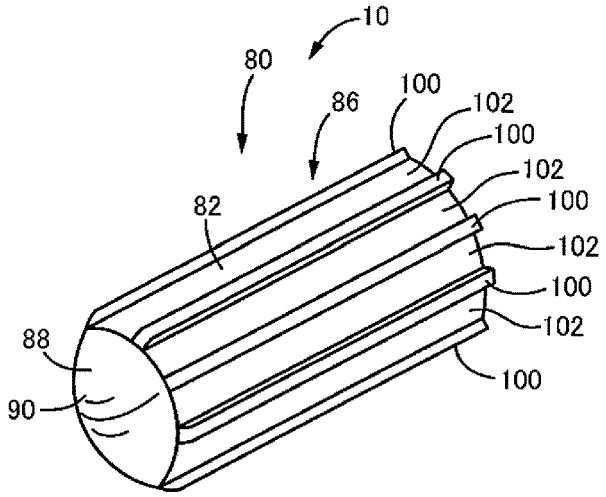
FIG. 3A is a perspective view illustrating the plunger depicted in FIG. 1.

Describing next the plunger 10 in more detail, as illustrated in FIG. 3A, the plunger 10 has a cylindrical main body portion 80 that extends axially. The main body portion 80 has a coaxial outer circumferential surface 82; in a state in which the plunger 10 is fitted in the cylinder 18 (hereinafter, referred to simply as the "fitted state"), the outer circumferential surface 82 faces an inner circumferential surface 84 of the cylinder 18 in a radial direction.

Figure 3B:
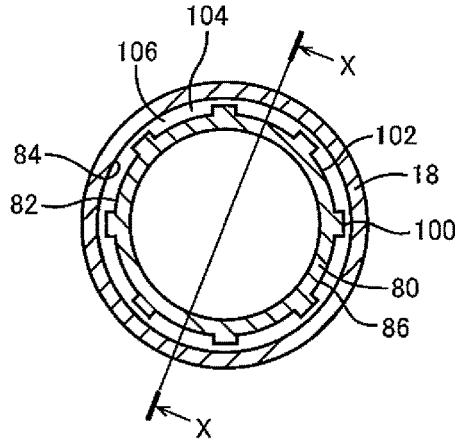
FIG. 3B is a cross-sectional view illustrating a relevant portion of the cartridge using the plunger depicted in FIG. 1.
Figure 3C:
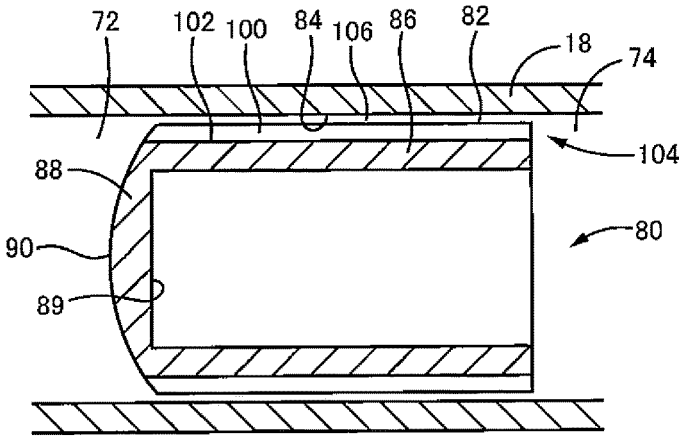
FIG. 3C is a cross-sectional view taken along line A-A in FIG. 3B.

In one example, the main body portion 80, as illustrated in FIGS. 3B and 3C, has a hollow circumferential wall 86, which axially extends in a uniform cross-section, and a bottom 88 that closes one end of the circumferential wall 86. In another example, the main body portion 80, although not shown, has a completely or partially solid portion that axially extends in a uniform cross-section, and a bottom that is formed at one end of the solid portion.

In one example, an exterior surface 90 of the bottom 88, as illustrated in FIGS. 3A and 3C, is shaped as a curved surface (e.g., a hemispherical surface) that is convex outwardly but devoid of any vertices. In another example, the exterior surface 90 of the bottom 88, although not shown, is shaped as a conical surface that is convex outwardly and has a vertex.

As illustrated in FIGS. 3A through 3C, on the plunger 10, on the outer circumferential surface 82 of the main body portion 80, multiple generally-axially-extending ridges 100 are arranged in circumferentially alternating relationship with multiple generally-axially-extending grooves 102. Due to this, a seal 104 that seals a space between the outer circumferential surface 82 of the plunger 10 and the inner circumferential surface 84 of the cylinder 18 is configured.

As illustrated in FIG. 3B, tip ends of the multiple ridges 100, in the fitted state, approach the inner circumferential surface 84 of the cylinder 18 more closely than the multiple grooves 102 but do not touch it, thereby forming, in the fitted state, a tubular clearance, which continuously extends both axially and circumferentially and serves as a continuous clearance 106, between the multiple ridges 100 and the multiple grooves 102 and the inner circumferential surface 84 of the cylinder 18.

Figure 4:
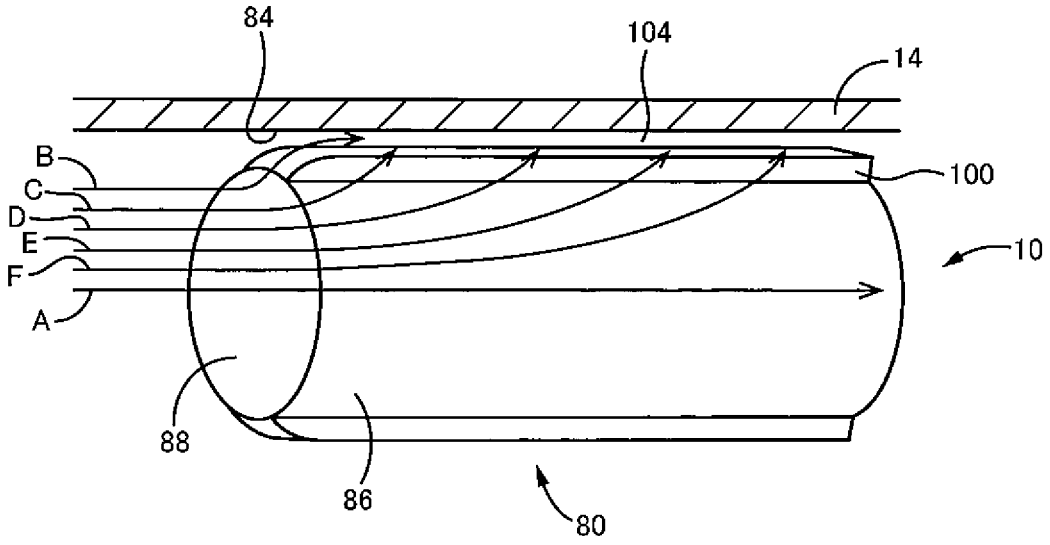
FIG. 4 is a perspective view that conceptually shows how a viscous material travels, while the viscous material is being filled into a filling chamber from the outside, from the filling chamber into a clearance between the plunger and the cylinder, and eventually forms a seal in the cartridge depicted in FIG. 1.

As illustrated in FIG. 4, when the viscous material 14 is being filled into the filling chamber 72 from the outside, the continuous clearance 106 is filled sequentially from an upstream side to a downstream side with a portion of the viscous material 14. At this time, said portion of the viscous material 14 flows, within each groove 102 as arrow A shows, principally axially from the upstream side to the downstream side at a speed faster than other portions. In addition, another portion of the viscous material 14 flows, on each ridge 100 as arrow B shows, principally axially from the upstream side to the downstream side, while still other portions of the viscous material 14, as arrows C, D, E and F show, initially move principally axially along each groove 102, eventually move circumferentially from the groove 102 and move onto the ridge 100 that is adjacent to that groove 102.

As understood from the foregoing, in the filling phase, a portion of the viscous material 14 flows within the continuous clearance 106 both axially and circumferentially, thereby filling the entire continuous clearance 106 with the portion of the viscous material 14. As a result, the portion of the viscous material 14 supplied from the filling chamber 72, which fills the continuous clearance 106, blocks another portion of the viscous material 14 from leaking from the filling chamber 72 into the pressurizing chamber 74. In other words, a portion of the viscous material 14 is used to form the seal 104; more specifically, a portion of the viscous material 14 is used to form the seal 104 in order to seal the rest of the viscous material 14.

A plurality of factors are respectively set, including the shape of the plunger 10 (e.g., the number of the ridges 100, the shape of each ridge 100), the size of the plunger 10 (e.g., the widths and heights of the ridges 100), and the surface roughness of the plunger 10, so that, at an end time point of the filling phase, i.e., the time point at which a predetermined volume of the viscous material 14 has filled into the filling chamber 72, the continuous clearance 106 is completely filled with the viscous material 14 without exceeding a pre-specified amount of the viscous material 14 that is forced out of the continuous clearance 106 on the downstream side.

To illustrate the effects of these factors, as the number of the ridges 100 increases, the resistance when the viscous material 14 moves within the continuous clearance 106 increases, and its speed decreases. Likewise, as the width dimension of each ridge 100 increases (i.e., as the width dimension of each groove 102 decreases), the resistance when the viscous material 14 moves within the continuous clearance 106 increases, and its speed decreases. Likewise, as the height of each ridge 100 increases, the resistance when the viscous material 14 moves within the continuous clearance 106 increases, and its speed decreases.

In addition, the resistance when the viscous material 14 moves within the continuous clearance 106 is higher in case the surface of the plunger 10 is an uneven surface than in case the surface of the plunger 10 is a smooth surface that does not substantially have any surface irregularities, and its speed decreases.

Describing the behavior of the viscous material 14 in more detail, in the filling phase in which the viscous material 14 is filled into the filling chamber 72 from the outside, a portion of the viscous material 14 travels from the filling chamber 72 into the continuous clearance 106, thereby filling the continuous clearance 106 with the portion of the viscous material 14 that serves as a fill viscous-material 14.

In the filled state, the fluidity of the fill viscous-material 14 within the continuous clearance 106 varies such that the fluidity is higher in the axial direction than in the circumferential direction, and the fill viscous-material 14 is allowed to flow circumferentially between the ridges 100 and the grooves 102 that are adjacent, thereby facilitating the filling of the continuous clearance 106 with the fill viscous-material 14 both in the axial and circumferential directions.

In the fully-filled state in which the continuous clearance 106 is fully filled with the fill viscous-material 14, the fill viscous-material 14 itself blocks the rest of the viscous material 14 from leaking from the filling chamber 72 into the pressuring chamber 74.

In a pre-fully-filled state prior to the fully-filled state, unwanted gasses, which unwantedly exist in the filling chamber 72, are allowed to vent, via a portion of the continuous clearance 106 that has not yet filled with the fill viscous-material 14, into the pressurizing chamber 74.

In a discharging phase in which, in the fully-filled state, the pressurized gas is introduced into the pressurizing chamber 74 to discharge the viscous material 14 from the filling chamber 72, the fill viscous-material 14 blocks the pressurizing gas from leaking from the pressurizing chamber 74 into the filling chamber 72.

As is evident from the foregoing explanation, in the present embodiment, multiple generally-axially-extending ridges 100 are formed on the outer circumferential surface 82 of the plunger 10, such that the ridges 100 are spaced apart from each other in the circumferential direction. In a coaxially fitted state in which the plunger 10 is coaxially fitted in the cylinder 18, the continuous clearance 106 is formed between the outer circumferential surface 82 of the plunger 10 and the inner circumferential surface 84 of the cylinder 18, such that the continuous clearance 106 continuously extends both circumferentially and axially. At this time, because a radial clearance also forms between the tip end surface of each ridge 100 and the inner circumferential surface 84 of the cylinder 18, the continuous clearance 106 is not partitioned by each ridge 100.

In the state in which the continuous clearance 106 has formed, when a portion of the viscous material 14 is filled into the filling chamber 72 within the cylinder 18 from the outside, the continuous clearance 106 is entirely filled with said portion of the viscous material 14. The continuous clearance 106, which has been filled with said portion of the viscous material 14, functions as the seal 104 overall, and at this time, said portion of the viscous material 14 serving as the filler forms the seal 104.

As a result, according to the present embodiment, in the filling phase of the viscous material 14, prior to completion of the seal 104, intentional venting (i.e., degassing of the viscous material 14 within the filling chamber 72) can be achieved, while, after completion of the seal 104, unintentional leakage of the viscous material 14 can be prevented; furthermore, in the discharge phase of the viscous material 14, unintentional leakage of pressurized air is prevented throughout this entire stage.

Further, according to the present embodiment, the continuous clearance 106 is formed between the outer circumferential surface 82 of the plunger 10 and the inner circumferential surface 84 of the cylinder 18, thereby reducing the outer diameter of the outer circumferential surface 82 relative to the inner diameter of the inner circumferential surface 84 by a larger factor than in cases in which the above-described circumferential lands are used.

As a result, simultaneously contactable regions of the outer circumferential surface 82 of the plunger 10, for which there is a possibility of simultaneously contacting with the inner circumferential surface 84 of the cylinder 18 at each moment of time (e.g., the total area of the simultaneously contactable regions over the total length of the outer circumferential surface 82, or otherwise the total circumferential length of a curve obtained by virtually transversely cutting the simultaneously contactable regions of the outer circumferential surface 82 at a particular axial position), decrease more than in cases in which the above-described circumferential lands are used instead of the axial ridges 100.

The reduction of the simultaneously contactable regions allows the resistance to axially sliding movements of the plunger 10 relative to the cylinder 18 to decrease more than in cases in which the above-described circumferential lands are used instead of the axial ridges 100. Thereby, in the discharging phase of the viscous material 14 from the pneumatic dispenser 20, the plunger 10 is caused to slide more smoothly when actuated by the pressurized gas than in cases in which the above-described circumferential lands are used instead of the axial ridges 100.

As a result, even if the aforementioned tilting moment unintentionally occurs on the plunger when the pressurized gas acts on the plunger, the plunger 10 tilts relative to the cylinder 18, and the plunger 10 locally contacts the cylinder 18, the risk of the plunger 10 being stuck at the same axial position is reduced. That is, the phenomenon of the plunger 10 being unintentionally stuck in the cylinder 18 due to tilting of the plunger 10 is prevented.

When the adherence of the plunger 10 is prevented, an excessive rise in the rear pressure on the plunger 10 is prevented, the occurrence of a larger tilting moment is prevented, the plunger 10 is prevented from tilting relative to the cylinder 18 largely, and the plunger 10 is prevented from strongly contacting the cylinder 18 in a local manner.

As a result, in the discharging phase of the viscous material 14 from the pneumatic dispenser 20, gaps in the completed seal 104 due to tilting of the plunger 10 are prevented from occurring. When the occurrence of such gaps is prevented, the pressurized gas is prevented from leaking from the pressurizing chamber 74 into the filling chamber 72.

Because of the foregoing, according to the present embodiment, in the discharging phase of the viscous material 14 from the pneumatic dispenser 20, unintentional tilting of the plunger 10 relative to the cylinder 18 is prevented, thereby eliminating or reducing the risk of bubbles being entrapped in the viscous material 14 within the filling chamber 72 due to the unintentional tilting.

Next, the plunger 10 will be exemplified in more detailed structure.

As illustrated in FIGS. 3A and 3B, in the present embodiment, the plunger 10 has eight ridges 100. In another example, as illustrated in FIG. 5, the plunger 100 has four ridges 100. In either example, the same plunger 10 has multiple ridges 100.

As illustrated in FIG. 3B, in the present embodiment, the ridges 100 are spaced apart circumferentially on the outer circumferential surface 82 in an equidistant manner. In another example, although not shown, there is only a single ridge 100.

In any case, as long as at least one ridge 100 is formed on the outer circumferential surface 82 of the plunger 10, the continuous clearance 106 is comprised of at least one first region that generally axially extends, and at least one second region that generally axially extends and has a thickness smaller than that of the first region. The first and second regions are circumferentially aligned and alternate.

Now, describing the first region (smaller thickness region) and the second region (larger thickness region) in comparison, the first region can provide the function of facilitating the plunger 10 to slide within the cylinder 18 in a stable orientation that minimizes tilting of the plunger 10 as a particular function that the second region does not have, while the second region can provide the function of facilitating the viscous material 14 to smoothly axially flow between the plunger 10 and the cylinder 18 as a particular function that the first region does not have. Every one of the first and second regions, however, provides a sealing function because of the filling of a portion of the viscous material 14, thereby blocking the rest of the viscous material 14.

As illustrated in FIG. 3A, in the present embodiment, each ridge 100 is straight in shape and extends along one generator of the outer circumferential surface 82 of the plunger 10. In other words, each ridge 100 has only a component that extends in the axial direction and does not have a component that extends in the circumferential direction.

In another example, although not shown, each ridge 100 is spiral in shape and extends transversely across a plurality of generators of the outer circumferential surface 82 of the plunger 10. In other words, each ridge 100 has not only a component that extends in the axial direction but also a component that extends in the circumferential direction.

Further, in either example, these multiple ridges 100 do not intersect on the outer circumferential surface 82 of the plunger 10. There is no intersection between the multiple ridges 100; if there were intersections, it is expected that the smooth flow of the viscous material 14 on the outer circumferential surface 82 of the plunger 10 would be physically impeded by such intersections.

As illustrated in FIGS. 3A and 3B, in the present embodiment, each of the ridges 100 has a smaller width dimension than each of the grooves 102.

As illustrated in FIGS. 3A and 3C, in the present embodiment, at least one of the ridges 100 extends along the substantially entire length of the plunger 10. The greater the length of each ridge 100 is, the smaller the maximum possible value of a tilt angle of the plunger 10 relative to the cylinder 18 becomes, which is effective to reduce the tilt angle of the plunger 10.

Figure 5A:
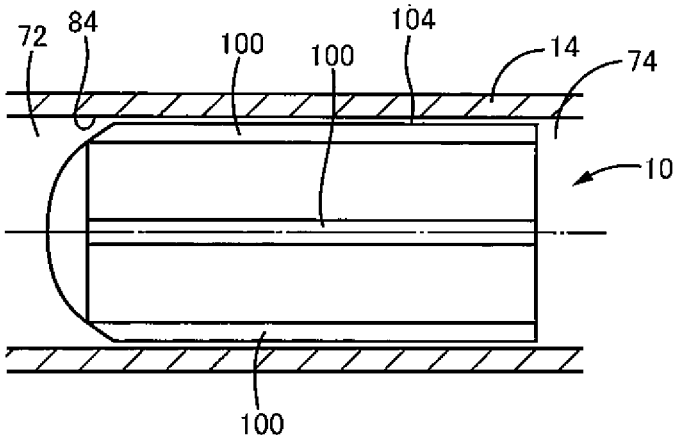
FIG. 5A is a side view illustrating one example of the plunger depicted in FIG. 1, which has ridges having a width dimension that does not change along its axis.

As illustrated in FIG. 5A, in the present embodiment, at least one of the ridges 100 has a constant width dimension along the length of the plunger 10.

Figure 5B:
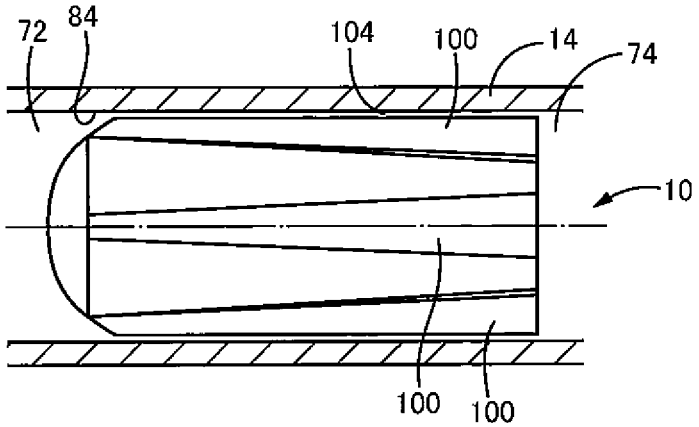
FIG. 5B is a side view illustrating another example of the plunger depicted in FIG. 1, which has ridges having a width dimension that gradually changes along its axis.

As illustrated in FIG. 5B, in another example, at least one of the ridges 100 has a width dimension that increases in the direction from the filling chamber 72 to the pressurizing chamber 74.

In the example depicted in FIG. 5B, a circumferential gap between the ridges 100 is smaller near the pressurizing chamber 74 than near the filling chamber 72, whereby the sealing ability achieved by the seal 104 in the discharging phase is more enhanced near the pressurizing chamber 74 than near the filling chamber 72. As a result, according to this example, the risk of the pressurized gas leaking from the pressurizing chamber 74 to the filling chamber 72 in the discharging phase can be effectively curtailed.

Figure 6A:
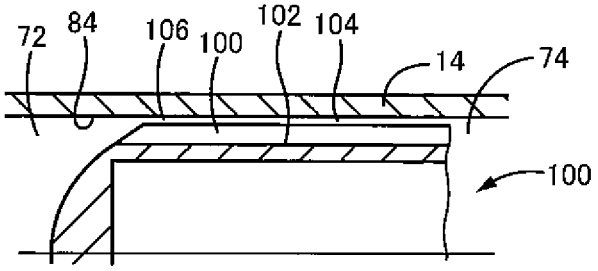
FIG. 6A is a side view illustrating one example of the plunger depicted in FIG. 1, which has ridges having a height dimension that does not change along its axis.

As illustrated in FIG. 6A, in the present embodiment, at least one of the ridges 100 has a height dimension, from a bottom surface (having an outer diameter axially constant) of an adjacent one of the grooves 102, that does not change along the length of the plunger 10.

Figure 6B:
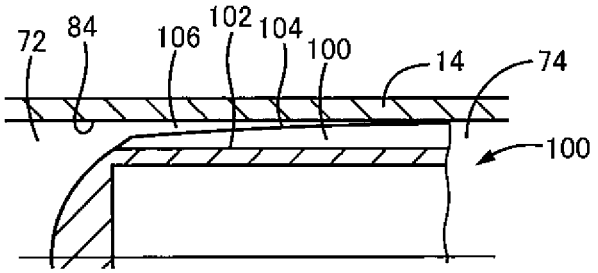
FIG. 6B is a side view illustrating another example of the plunger depicted in FIG. 1, which has ridges having a height dimension that gradually changes along its axis.

As illustrated in FIG. 6B, in another example, at least one of the ridges 100 has a height dimension, from a bottom surface of an adjacent one of the grooves 102, that increases along the length of the plunger 10 in the direction from filling chamber 72 to the pressurizing chamber 74. The example depicted in FIG. 6B may be combined with the example depicted in FIG. 5B.

In the example depicted in FIG. 6B, the thickness of the smallest clearance within the continuous clearance 106 (i.e., the smallest one of the thicknesses of a clearance between the tip end surfaces of the ridges 100 and the inner circumferential surface 84 of the cylinder 18) becomes smaller at a position near the pressurizing chamber 74 than at a position near the filling chamber 72, whereby the sealing ability of the seal 104 in the discharging phase is increased at a position near the pressurizing chamber 74 more than at a position near the filling chamber 72. As a result, according to this example, the risk of the pressurized gas leaking from the pressurizing chamber 74 to the filling chamber 72 in the discharging phase can be effectively curtailed.

Figure 5C:
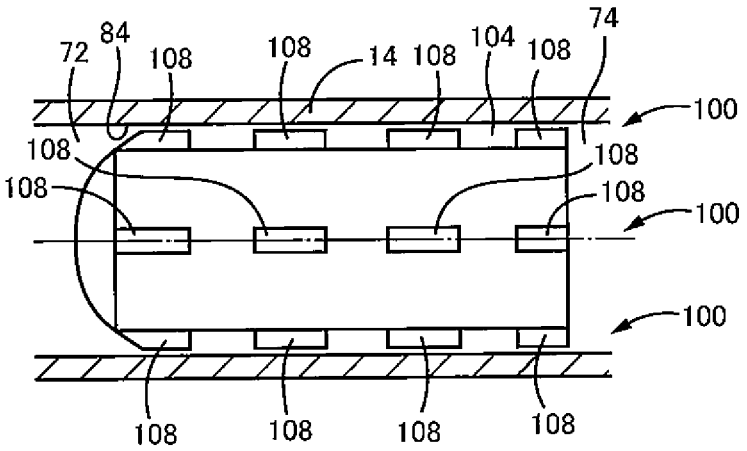
FIG. 5C is a side view illustrating still another example of the plunger depicted in FIG. 1, which has ridges that are composed of multiple ridge segments that are discrete and aligned.

In one example, as illustrated in FIG. 5C, at least one of the ridges 100 is not continuous in the axial direction; multiple ridge segments 108, which are spaced apart from each other, are configured so as to be aligned in the axial direction.

In this example, the tendency, in which the ridges 100 reduce the circumferential fluidity of the viscous material 14 within the continuous clearance 106, is reduced more than in a case in which a single ridge 100 extends continuously. Due to this, it is expected that the time required for the entire continuous clearance 106 to be filled with the viscous material 14 can be shortened.

As illustrated in FIG. 3C, in the present embodiment, the plunger 10 adopts a hollow structure; the circumferential wall 86 of the main body portion 80 elastically deforms in the radial direction more easily than in case it adopts a solid structure.

In the present embodiment, the plunger 10 is radially deformable at its ridges 100; due to this, when the tip ends of the multiple ridges 100 contact the inner circumferential surface 84 of the cylinder 18, the ridges 100 elastically deform radially inwardly. As a result, the multiple ridges 100 are prevented from strongly contacting the inner circumferential surface 84 of the cylinder 18.

As illustrated in FIG. 3B, in the present embodiment, the cross section of each ridge 100 is a cross section having a generally rectangular shape.

In some other examples, the cross section of each ridge 100 may have a cross section with another shape, for example, a cross section that tapers radially outwardly (a cross section generally shaped as a triangle, hemisphere or trapezoid).

In these other examples, the circumferential fluidity of the viscous material 14 is higher when the cross section of each ridge 100 is generally shaped as a triangle, hemisphere or trapezoid, thereby facilitating the filling of the radial clearance between the tip end surface of each ridge 100 and the inner circumferential surface 84 of the cylinder 18 with the viscous material 14, than in cases in which the cross section of each ridge 100 is generally rectangular shaped.

As illustrated in FIG. 3B, in the present embodiment, the cross section each groove 102 is a cross section having a generally rectangular shape.

In some other examples, each groove 102 may have a cross section with another shape, for example, a cross section that tapers radially inwardly (a cross section generally shaped as a triangle, hemisphere or trapezoid). In one example, each ridge 100 has a cross section that tapers radially outwardly, while each groove 102 has a cross section that tapers radially inwardly.

As illustrated in FIG. 3B, in the present embodiment, in case the inner circumferential surface 84 of the cylinder 18 has a circular cross-section, if the outer circumferential surface 82 of the plunger 10 has a circular cross-section, outer outlines of respective segments that constitute a profile (shape), which represents the cross section obtained by transversely cutting the multiple ridges 100 at one axial position, are located on a perfect circle that is concentric with the plunger 10, thereby allowing these outer outlines to be described as a plurality of arcs sharing a single center.

In another example, although now shown, in case the inner circumferential surface 84 of the cylinder 18 has a circular cross-section, if the outer circumferential surface 82 of the plunger 10 has a non-circular cross-section, multiple outer outlines corresponding to the multiple ridges 100 are located on a single non-circular endless-line (e.g., an oval, an ellipse, a polygon) that is concentric with the plunger 10.

Next, the plunger 10 will be described with regard to its aspect ratio (height to length ratio) taken in side view.

An axial dimension that represents the plunger 10 (e.g., in FIG. 3C, the axial length from the edge position of the circumferential wall 86 on the side of the filling chamber 72 to the edge position on the side of the pressurizing chamber 74) is larger than a diametrical dimension that represents the same plunger 10 (e.g., in FIG. 3B, the diameter of the circle that circumscribes the silhouette obtained by projecting the plunger 10 in the axial direction). When the pressurized gas acts, the maximum value of the angle that the plunger 10 unintentionally tilts within the cylinder 18 due to the pressurized gas decreases by such a dimensional effect.

The aspect ratio, which is the ratio of the axial dimension, which represents the plunger 10, to the diametrical dimension, which represents the same plunger 10, may be about 1 or more, about 1.2 or more, or about 1.5 or more; as this aspect ratio becomes bigger, the anti-tilting effect of the plunger 10 within the cylinder 18 increases.

Next, referring to FIG. 11, a filling method that fills the viscous material 14 into the cartridge 12 will be described.

Figure 7:
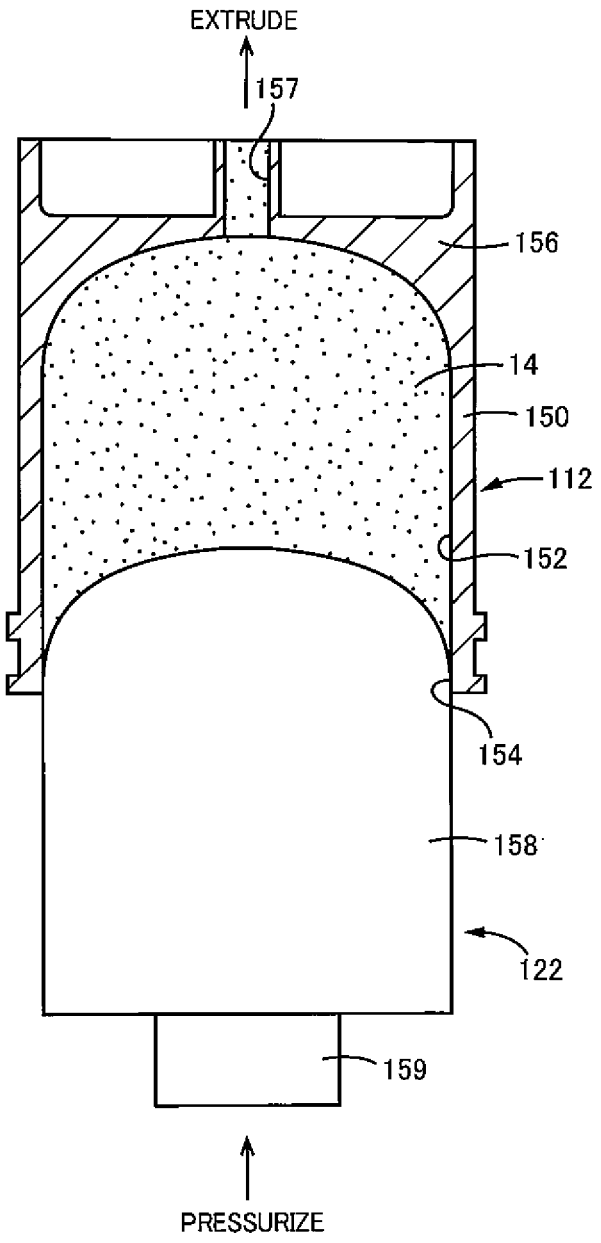
FIG. 7 is a cutaway cross-sectional side view illustrating a container set of a filling device for use in effecting a filling method for filling the cartridge depicted in FIG. 2 with the viscous material, the container set being constructed by inserting a pusher piston into a container.

Prior to filling of the cartridge 12, the viscous material 14 is produced and stored in the container 112 depicted in FIG. 7. Then, the viscous material 14 that has been stored in the container 112 is dispensed from the container 112 into a plurality of cartridges 12. The viscous material 14 is extruded from the container 112 as the pusher piston 122 is forced into the container 112. The extruded viscous material 14 is filled into the cylinder 18.

FIG. 7 illustrates the container 112 in a cross-sectional side view. In the present embodiment, the same container 112 is used for the production of the viscous material 14 (two-component mixing, as described below), the degassing of the viscous material 14 (centrifugal vacuum degassing using a mixer, as described below) after the production thereof, the storage and transportation of the viscous material 14 prior to filling into the cartridge 12, and the filling to the cartridge 12.

As FIG. 7 illustrates, the container 112 has a longitudinally-extending hollow housing 150 and a cylindrical chamber 152 that is formed coaxially within the housing 150. The chamber 152 has an opening 154 and a base portion 156. The base portion 156 has a recess that forms a generally hemispherical shape. Because the base portion 156 has a continuous shape, the viscous material 14 flows in the chamber 152 more smoothly than if the base portion 156 had a flat shape; as a result, the mixing efficiency of the viscous material 14 is improved. An example of a material constituting the container 112 is POM (polyacetal); another example is Teflon (registered trademark), although these are not limiting.

In the base portion 156 of the chamber 152, a discharge passage 157 is formed for discharging the viscous material 14 (a mixture of Solutions A and B), which is contained within the chamber 152, into the cartridge 12; the discharge passage 157 is selectively closed by a removable plug (not shown).

As illustrated in FIG. 7, the pusher piston 122 is pushed into the chamber 152 of the container 112 in order to discharge the viscous material 14 from the container 112. The pusher piston 122 has a main body portion 158 and an engagement portion 159 formed at the rear end of the main body portion 158. The main body portion 158 has an exterior shape that is complementary to the interior shape of the chamber 152 of the container 112 (e.g., an exterior shape having a protrusion that forms a generally hemispherical shape). The engagement portion 159 is smaller in diameter than the main body portion 158; when an external force is loaded by a filling device 210, the pusher piston 122 advances. As the pusher piston 122 moves within the chamber 152 closer to the discharge passage 157, the viscous material 14 is extruded from the discharge passage 157.

Figure 8:
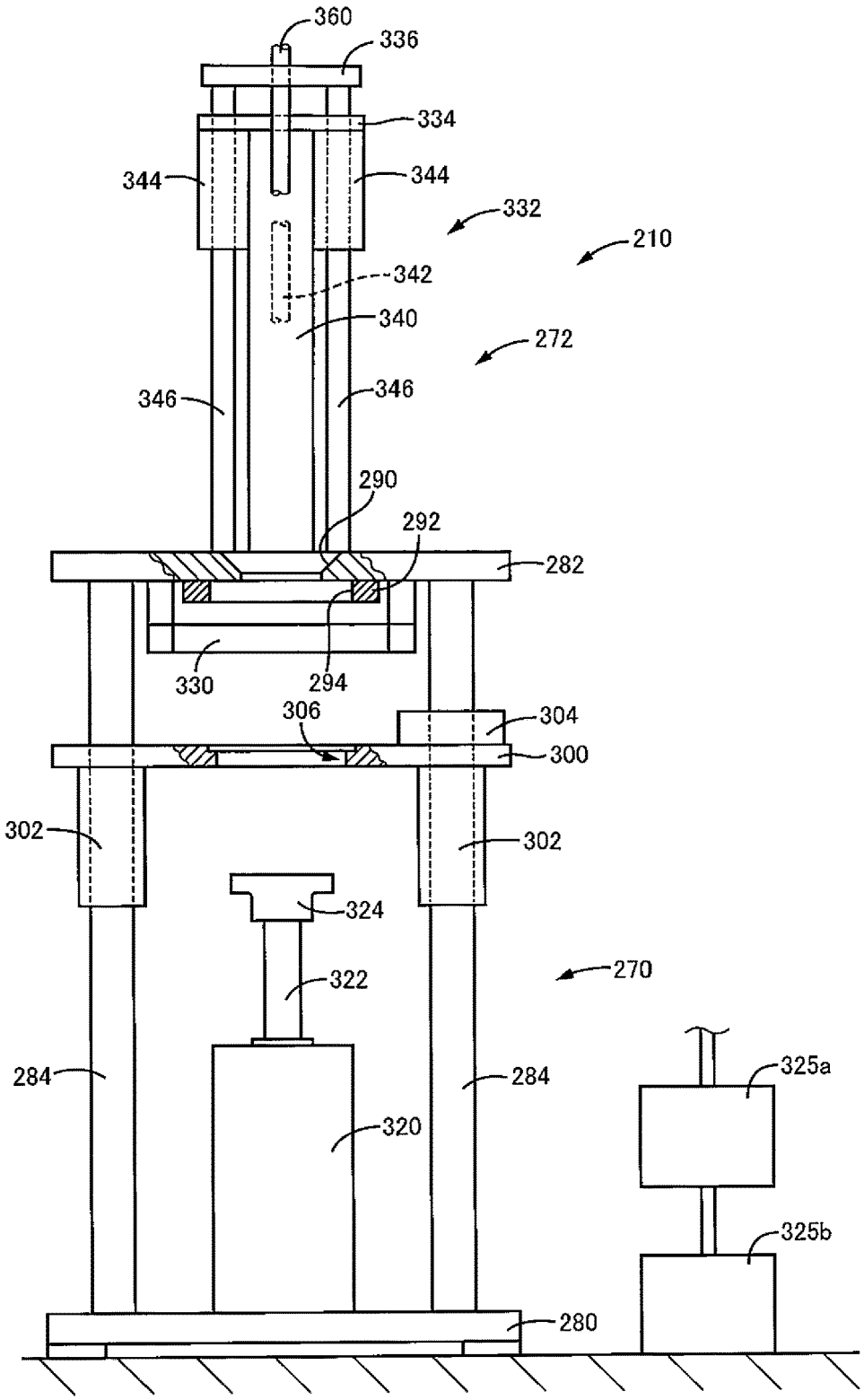
FIG. 8 is a cutaway cross-sectional front view illustrating the filling device.
Figure 9:
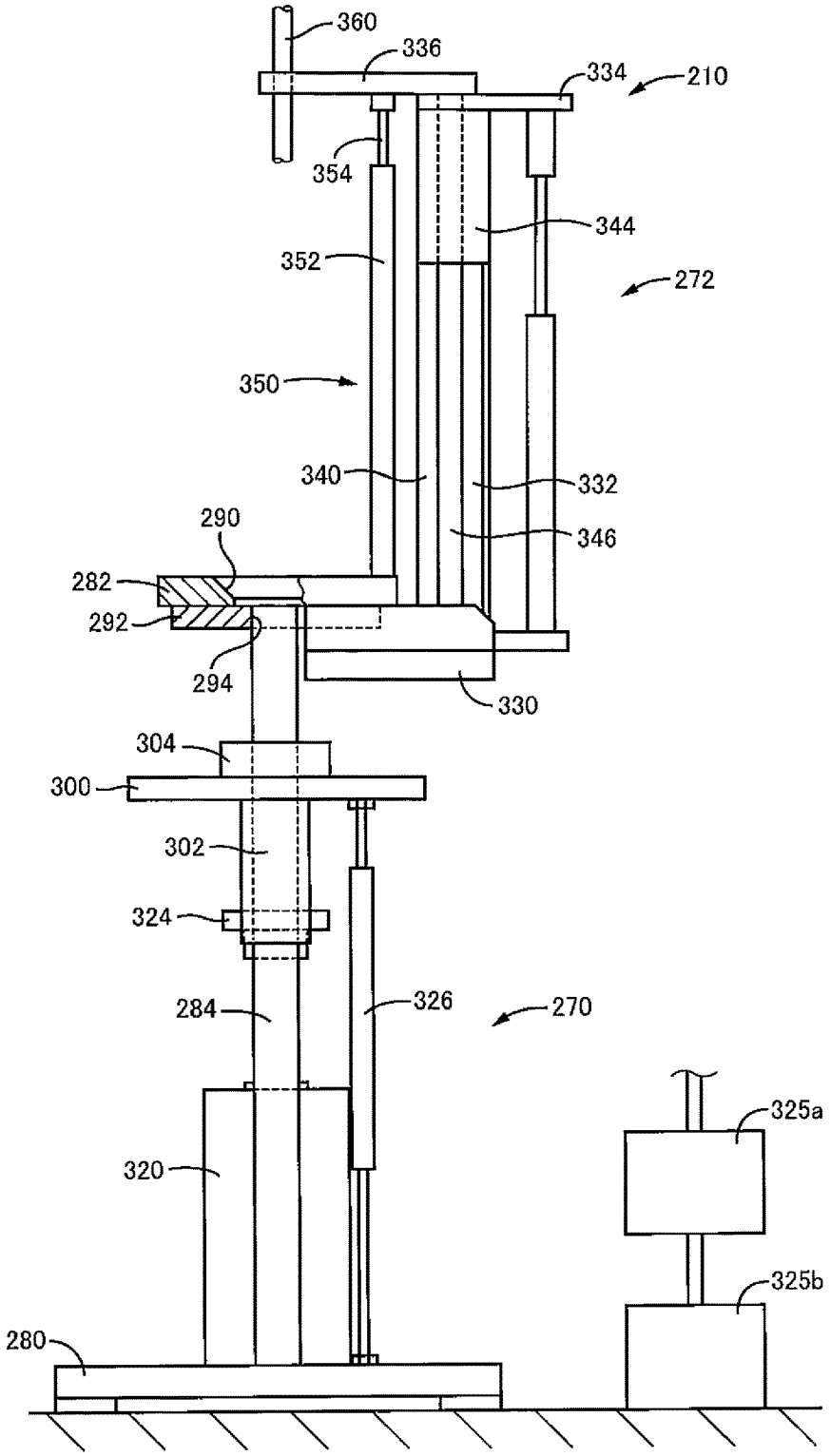
FIG. 9 is a cutaway cross-sectional side view illustrating the filling device.
Figure 10:
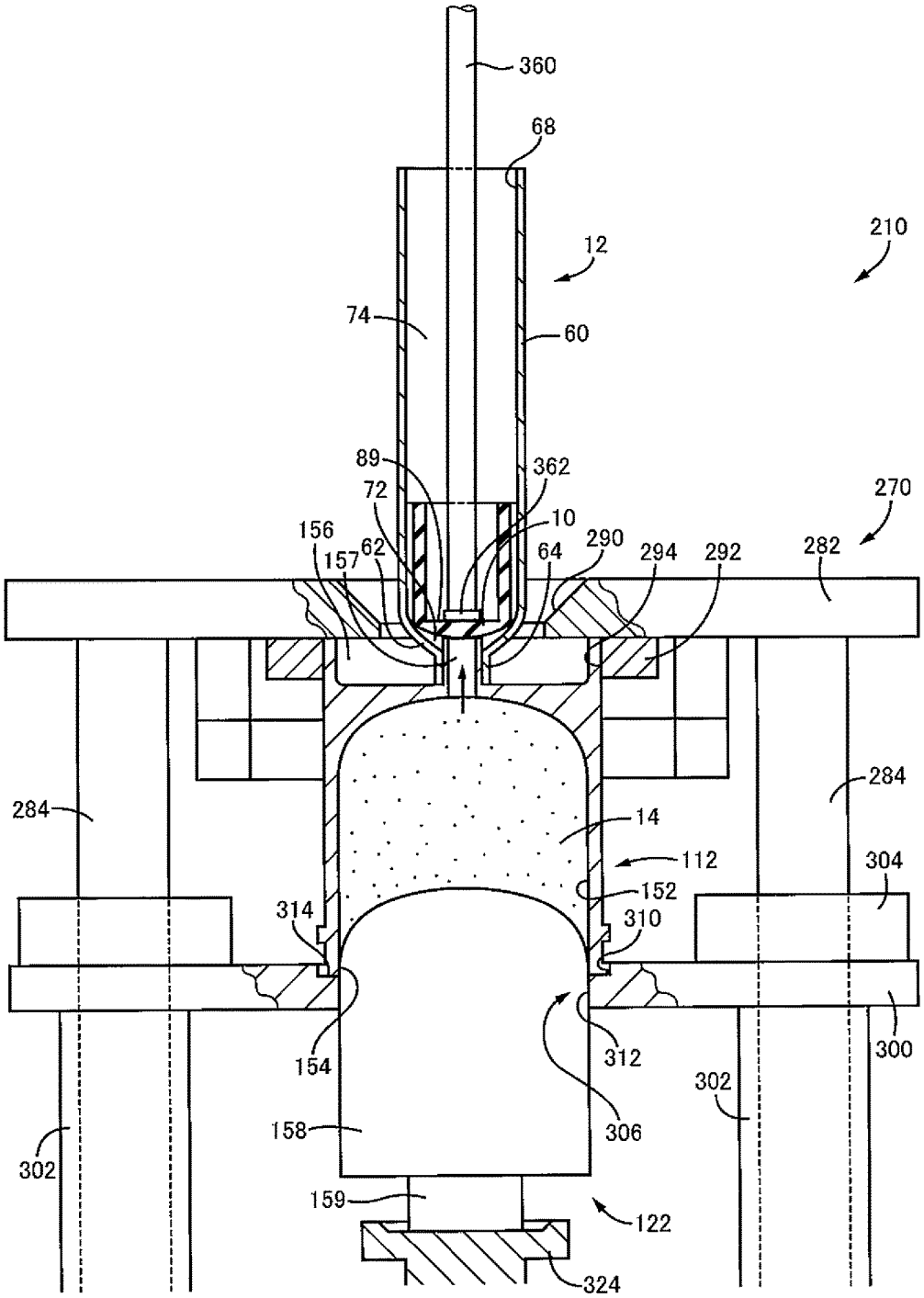
FIG. 10 is a cutaway cross-sectional front view illustrating a relevant portion of the filling device when in use.

FIG. 8 illustrates the filling device 210, which is for use in transferring the viscous material 14 from the container 112 to the cartridge 12, thereby filling the cartridge 12 with the viscous material 14, FIG. 9 illustrates the filling device 210 in a cutaway cross-sectional side view, and FIG. 10 illustrates a relevant portion of the filling device 210 when in use illustrating the filling device in a cutaway cross-sectional front view in enlargement.

In the present embodiment, while transferring the viscous material 14 from the container 112 to the cartridge 12, the container 112 is held in space, as illustrated in FIG. 10, such that the container 112 is oriented with the opening 154 of the chamber 152 facing downward and the discharge passage 157 of the base portion 156 facing upward (upside-down position). In this state, the pusher piston 122 is moved upwardly within the chamber 152. As a result, the viscous material 14 is upwardly extruded from the chamber 152.

Furthermore, while transferring the viscous material 14 from the container 112 to the cartridge 12, the cartridge 12 is held in space with the opening 68 facing upward and with the base portion 62 facing downward. In this state, when the viscous material 14 is upwardly extruded from the container 112, it is injected via the base portion 62 of the cartridge 12.

As FIGS. 8 and 9 illustrate, the filling device 210 at its lower portion has a container holder mechanism 270 that removably holds the container 112; on the other side, the filling device 210 at its upper portion has a cartridge holder mechanism 272 that removably holds the cartridge 12.

The container holder mechanism 270 has abase plate 280, which sits on the ground, a top plate 282, which is not vertically movable and is located above the base plate 280, and a plurality of vertical parallel shafts 284, each of which is fixedly secured at its two ends to the base plate 280 and the top plate 282 (in the present embodiment, as illustrated in FIGS. 8 and 9, two shafts disposed symmetrically relative to a vertical centerline of the container holder mechanism 270). The top plate 282 has a through hole 290. The through hole 290 is coaxial with the vertical centerline of the container holder mechanism 270.

A guide plate 292 is fixedly secured to a lower face of the top plate 282. The guide plate 292 has a guide hole 294 coaxial with the through hole 290. The guide hole 294 penetrates through the guide plate 292 in the thickness direction with a uniform cross-section. The guide hole 294, as illustrated in FIG. 10, has an inner diameter that is slightly larger than the outer diameter of the base portion 156 of the container 112, and it is possible to fit the container 112 within the guide hole 294 without any noticeable play. Due to the guide hole 294, the container 112 is aligned relative to the top plate 282 in the horizontal direction (the radial direction of the container 112).

As FIG. 10 illustrates, when the base portion 156 of the container 112 is in the state that it is fitted in the guide hole 294, the container 112 at a tip end surface of the base portion 156 (in the same flat plane) abuts on the lower surface of the top plate 282. As a result, the container 112 can be aligned relative to the top plate 282 in the vertical direction (the axial direction of the container 112).

As FIGS. 8 and 9 illustrate, the container holder mechanism 270 further has a vertically movable plate 300. The movable plate 300 has a plurality of sleeves 302, into which the shafts 284 are axially slidably fitted. By manipulating a lock mechanism 304, the operator can move the movable plate 300 and stop the movement in any position in the vertical direction.

The movable plate 300 has a stepped positioning hole 306 coaxial with the guide hole 294. The positioning hole 306 penetrates through the movable plate 300 in the thickness direction. As FIG. 10 illustrates, the positioning hole 306 has a larger-diameter hole 310 on the side closer to the guide hole 294, a smaller-diameter hole 312 on the opposite side, and a shoulder surface 314 between the larger-diameter hole 310 and the smaller-diameter hole 312 and facing towards the guide hole 294.

The larger-diameter hole 310 has an inner diameter that is slightly larger than the outer diameter of the opening 154 of the container 112 and the container 112 is aligned relative to the movable plate 300 (and therefore the top plate 282) in the horizontal direction (the radial direction of the container 112).

The tip end surface of the opening 154 of the container 112 (in the same flat plane) abuts on the shoulder surface 314, and the container 112 is aligned relative to the movable plate 300 (therefore the top plate 282) in the vertical direction (the axial direction of the container 112).

The smaller-diameter hole 312 has an inner diameter that is slightly larger than the outer diameter of the pusher piston 122, and the pusher piston 122 is slidably fitted into the smaller-diameter hole 312. The smaller-diameter hole 312 serves as a guide hole for guiding axial movement of the pusher piston 122.

A container set is constructed by inserting the pusher piston 122 into the container 112, and the container set is attached to the top plate 282, with the movable plate 300 sufficiently spaced from the top plate 282 in the downward direction. Thereafter, the movable plate 300 is upwardly moved until the tip end face of the opening 154 of the container 112 abuts on the shoulder surface 314. At this position, the movable plate 300 is fixedly secured to the shafts 284. As a result, the retention of the container set on the container holder mechanism 270 is completed.

As FIGS. 8 and 9 illustrate, the container holder mechanism 270 further has an air cylinder 320 serving as an actuator and coaxial with the guide hole 294. A rod 322, which serves as a vertically movable member, upwardly projects from the air cylinder 320, and a pusher 324 is affixed at the tip end of the rod 322. The pusher 324, as illustrated in FIG. 10, engages with the engagement portion 159 of the pusher piston 122 of the container set that is held in the container holder mechanism 270. In the engagement position, as the pusher 324 advances, the pusher piston 122 advances relative to the container 112 so as to reduce the volume of the chamber 152.

The air cylinder 320 is double-acting and, based on the operator's actions, the pusher 324 thereof selectively advances from an initial position to an active position (upward movement by pressurization), retreats from the active position to an inactive position (downward movement by pressurization), and stops at any desired position (from both gas chambers within the air cylinder 320). The air cylinder 320 is connected to a high-pressure source (its primary pressure is, e.g., 0.2 MPa) **325*b* via a hydraulic pressure control unit 325*a*** having flow control valve(s).

As FIG. 9 illustrates, the container holder mechanism 270 further has a gas spring 326 serving as a damper. The gas spring 326 extends vertically and is pivotably coupled at its two ends with the base plate 280 and the movable plate 300, respectively. The gas spring 326 is provided to restrict the downward movement of the movable plate 300 due to gravity when the lock mechanism 304 is in an unlocked position.

As FIGS. 8 and 9 illustrate, the cartridge holder mechanism 272 is equipped with a base frame 330 that is fixedly secured to the top plate 282, an air cylinder 332 serving as an actuator, a top frame 334 and a movable frame 336.

The air cylinder 332 has a vertically-extending main body 340, which is fixedly secured to the top plate 282 and the top frame 334, and a vertically-movable rod 342 that is linearly movable relative to the main body 340. The upper end of the vertically-movable rod 342 (the end of the vertically-movable rod 342 that projects from the main body 340) is fixedly secured to the movable frame 336.

The air cylinder 332 is double acting, and based on operator's actions, the vertically-movable rod 342 thereof selectively advances from an initial position to an active position (upward movement by pressurization), retreats from the active position to an inactive position (downward movement by pressurization), and floats at any desired position (permitting exhaust from both gas chambers in the air cylinder 332). That is, the air cylinder 332 can selectively switch between an advanced mode, a retracted mode and a floating mode. The air cylinder 332 is connected to the high pressure source 325*a* via a hydraulic pressure control unit 325*a*.

A plurality of sleeves 344 (in the present embodiment, two parallel sleeves disposed symmetrically with the air cylinder 332 interposed therebetween) is fixedly secured to the main body 340. A plurality of vertically-extending shafts 346 is slidably fitted into the respective sleeves 344. The upper end portion of each shaft 346 is fixedly secured to the movable frame 336.

Each of the base frame 330, the top frame 334, the main body 340 and the sleeves 344 is a stationary member in the cartridge holder mechanism 272, while the movable frame 336, the vertically-movable member 142, and the shafts 346 are each movable members that vertically move in unison.

As FIG. 9 illustrates, the cartridge holder mechanism 272 is further equipped with a gas spring 350 serving as a damper. The gas spring 350 extends vertically between the base frame 330 and the movable frame 336. The gas spring 350 is equipped with a cylinder 352 having a gas chamber (not shown), and a rod 354 that is extendable and retractable relative to the cylinder 352. At one end thereof, it is pivotably coupled to the base frame 330.

A tip end of the rod 354 detachably engages a lower surface of the movable frame 336. As a result, although the movable frame 336 can compress the rod 354, it cannot extend the rod 354. When in a compressed state, the rod 354 applies an upward force against the movable frame 336, which assists the upward movement of the movable frame 336.

In the present embodiment, the container 112 and the cartridge 12 are directly coupled together, e.g., by screwing together male and female threads, with the container 112 retained in the filling device 210, and the cartridge 12 is aligned relative to the container 112 in both of the radial direction and the axial direction.

As FIG. 10 illustrates, a rod 360 is inserted into the cartridge 12, with the aforementioned container set held by the container holder mechanism 270, and with the aforementioned container set coupled to the cartridge 12.

The rod 360 is held by the cartridge holder mechanism 272. In the present embodiment, the cartridge holder mechanism 272 holds the rod 360 and the rod 360 is, in turn, inserted into the cartridge 12; consequently, the cartridge 12 is held by the cartridge holder mechanism 272.

The rod 360 is in the form of a tube which extends linearly and is rigid, and a second plug 190, which is fixedly secured to the tip end of the vacuum tube 182. The rod 360 is a steel pipe (can be replaced with a plastic pipe), and is capable of transmitting compressive forces in the axial direction.

The rod 360 has an anterior end portion a tip end surface of which is closed in an air-tight manner by a stop 362. The stop 362 at its tip end surface is in abutment with the partition wall surface 89 of the plunger 10, which sets a definite approaching limit of the rod 360 relative to the plunger 10.

As FIG. 10 illustrates, by pushing the pusher piston 122 into the container 112, viscous material 14 is extruded from the container 112 via the base portion 156, and the extruded viscous material 14 fills the filling chamber 72. As the volume of viscous material 14 filling the filling chamber 72 increases, the plunger 10 is further displaced by the viscous material 14 and moves upwardly relative to the cylinder 18. Therefore, the rod 360 moves upwardly relative to the cartridge 12.

As FIGS. 8 and 9 illustrate, the rod 360 is fixedly secured to the movable frame 336. The rod 360 extends coaxially with the vertical centerline of the filling device 210 (coaxial with the centerline of the guide hole 294). Owing to the filling device 210, the cartridge 12 is aligned relative to the top plate 282.

Next, the filling method will be described in more detail with reference to the process flowchart depicted in FIG. 11, which is followed by description of how to prepare the viscous material 14.

The viscous material 14 is a high-viscosity synthetic resin, and exhibits thermosetting properties, such that the viscous material 14 cures when heated above a prescribed temperature (e.g., 50° C.); once cured, the original properties of the viscous material 14 will not be restored even if the temperature decreases. In addition, the viscous material 14 also exhibits the property that, when the viscous material 14 is cooled below a prescribed temperature (e.g., −20° C.) prior to curing and is frozen, the chemical reaction (curing) in the viscous material 14 stops. Thereafter, when the viscous material 14 is heated and thawed, the chemical reaction (curing) in the viscous material 14 restarts.

In the present embodiment, the viscous material 14 is a two-part mix type that is furnished by mixing two solutions, which are "Solution A" (curing agent) and "Solution B" (major component). An example of "Solution A" is PR-1776 B-2, Part A (i.e., an accelerator component, and a manganese dioxide dispersion) of PRC-DeSoto International, U.S.A., and an example of "Solution B," which is combined with Solution A, is PR-1776 B-2, Part B (i.e., a base component, and a filled modified polysulfide resin) of PRC-DeSoto International, U.S.A.

Therefore, as FIG. 11 illustrates, in order to produce the viscous material 14, the two parts are first mixed in the container 112 in step S11. Next, in step S12, agitating and degassing are performed on the viscous material 14 held in the container 112 using a mixer (not shown). In the present embodiment, the same container 112 is used to mix the two parts for the production of the viscous material 14, and to agitate and degas the viscous material 14 using the mixer.

An example of such a mixer is disclosed in Japanese Patent Application Publication No. H11-104404, the content of which is incorporated herein by reference in its entirety. In the present embodiment, such a mixer is used to orbit the container 112 around an orbital axis and simultaneously rotate the container 112 about a rotational axis that is eccentric to the orbital axis, with the container 112 filled with the viscous material 14 under a vacuum, so that the viscous material 14 can be simultaneously agitated and degassed within the container 112.

The viscous material 14 within the mixer is agitated due to the centrifugal force created by the planetary motion produced by the mixer. Further, air bubbles trapped in the viscous material 14 are released from the viscous material 14, due to the synergistic effect of the centrifugal force generated by the planetary motion of the mixer and the negative pressure caused by the vacuum atmosphere; as a result, the viscous material 14 is degassed. This completely or adequately prevents generation of voids within the viscous material 14.

After the viscous material 14 has been mixed and agitated/degassed within the container 112 in the manner described above, an operation that transfers and fills the viscous material 14 from the container 112 into the cartridge 12 starts as illustrated in FIG. 10.

In step S21, the operator first inserts the plunger 20 into the container 112 that has been filled with the viscous material 14, as illustrated in FIG. 7, to thereby prepare the container set.

Next, in step S22, the operator next attaches the container set to the container holder mechanism 270 of the filling device 210 with the container set inverted, as illustrated in FIG. 10, to thereby retain the container set in the filling device 210.

More specifically, prior to the retention of the container set in the container holder mechanism 270, the movable plate 300 is retreated downwardly from the container set. The operator first puts the container set on the retreated movable plate 300 at a prescribed position and in an inverted orientation. Thereafter, the operator raises the movable plate 300 together with the container set until the container 112 abuts on the top plate 282. Lastly, the operator fixes the movable plate 300 at that position.

Subsequently, in step S23, the operator inserts the plunger 10 into the cartridge 12 as illustrated in FIG. 10, to thereby prepare the cartridge 12.

Thereafter, in step S24, the cartridge 12 is coupled to the container set, which was previously retained by the filling device 210 in an inverted orientation, in a substantially air-tight manner, as illustrated in FIG. 10, thereby retaining the cartridge 12 in the filling device 210.

Prior to the attachment of the cartridge 12 to the filling device 210, the air cylinder 332 is placed in the aforementioned advanced mode, in which the vertically-movable rod 342 is pushed out; as a result, the rod 360 is in a position that is upwardly retreated from the cartridge 12. In other words, the rod 360 does not obstruct the attachment of the cartridge 12 to the filling device 210.

Subsequently, in step S25, the air cylinder 332 is switched to the aforementioned retracted mode to retract the vertically-movable rod 342 and to thereby insert the retreated rod 360 into the cartridge 12. The rod 360 is downwardly moved by the air cylinder 332 until the stop 362 of the rod 360 abuts on the plunger 10, which was previously put into the cartridge 12. An advancing limit of the plunger 10 is defined by, for example, abutting on a tip end portion of a portion, which forms the discharge passage 157, within the base portion 156 of the container 112.

Thereafter, the air cylinder 332 is switched to the aforementioned floating mode; as a result, if the assistance by the gas spring 350 is disregarded, the force acting on the plunger 10 from the rod 360 has a value equal to the summation of the weight of the rod 360 and the weight of member(s), which move together with the rod 360, minus the value of the sliding resistance. This force is a force that urges the plunger 10 in the direction towards the base portion 62 of the cartridge 12, and is a force that reduces the volume of the filling chamber 72.

Thereafter, in step S26, the pusher piston 122 rises and is pushed into the container 112, as illustrated in FIG. 10. With this, the viscous material 14 is extruded from the container 112 against the force of gravity, to thereby initiate the filling of the filling chamber 72.

When the viscous material 14 flows from the container 112 into the filling chamber 72 of the cartridge 12, air present within the filling chamber 72 is compressed by the in-flowing viscous material 14.

As a result, a pressure differential is generated within the cartridge 12, because the filling chamber 72 is at a higher pressure than the pressurizing chamber 74 (at atmospheric pressure), which is in communication with outside of the cartridge 12. Due to this pressure differential, air within the filling chamber 72 flows into the pressurizing chamber 74 via the radial clearances between the plunger 10 and the cylinder 18 (while the seal 104 has not yet completed), and consequently, it is discharged from the opening 68 of the cartridge 12 to the outside. This allows the air in the filling chamber 72 to be degassed.

As a result, according to the present embodiment, during the filling of the viscous material 14 into the filling chamber 72, the air is discharged from the filling chamber 72, air is prevented from being incorporated into the viscous material 14 within the filling chamber 72, and co-existence of the viscous material 14 and air within the filling chamber 72 is prevented.

Further, according to the present embodiment, a force is applied to the plunger 10 within the cartridge 12 by the rod 360 in the direction that reduces the volume of the filling chamber 72. The applied force is a force that displaces the plunger 10 towards the viscous material 14 that has flowed into the cartridge 12.

For these reasons, according to the present embodiment, due to the application of the aforementioned force by the rod 360, the above-mentioned pressure differential is again created and a larger pressure differential is generated within the cartridge 12 than if a force were not applied by the rod 360. A phenomenon is thereby promoted that air present within the filling chamber 72 flows into the pressurizing chamber 74 through the radial clearances between the plunger 10 and the cylinder 18.

Thereafter, the entire filling chamber 72, which is in the initial state depicted in FIG. 10 (in which the plunger 10 is located at its lowermost position), is filled with the viscous material 14 (replacing the air initially present within the filling chamber 72 with viscous material 14). Subsequently, as the filling of the viscous material 14 continues, the volume of the filling chamber 72 increases and the plunger 10, the rod 360 and the movable frame 336 rise.

At this moment, a first portion of the viscous material 14 within the filling chamber 72 is consumed to form the seal 104; when the seal 104 is completed, the rest of the viscous material 14 from leaking into the pressurizing chamber 74 is prevented by the seal 104. Viscous material blocking is performed by the seal 104.

In the present embodiment, the viscous material 14 is filled into the plunger 10 via not the opening 68 but the discharge port 67, thereby, in an initial period from the start of the filling operation, creating a layer of air (an upper layer) closer to the plunger 10 in the filling chamber 72, and a layer of the viscous material 14 below the layer of air. As a result, as long as air is present within the filling chamber 72, the viscous material 14 is prevented from being brought into contact with the plunger 10.

When the viscous material 14 rises up in the filling chamber 72 and the filling chamber 72 is fully degassed, the viscous material 14 is brought into contact with the plunger 10 and enters the clearances between the plunger 10 and the cylinder 18. As a result, seals are created between the plunger 10 and the cylinder 18 for performing the aforementioned blockage of the viscous material 14. After the completion of the seals, bi-directional air-leakage is also inhibited.

Prior to the filling of the viscous material 14 into the cartridge 12, the gas spring 350 depicted in FIG. 9 is in a compressed state due to the movable frame 336. As a reaction thereto, the gas spring 350 applies a force to the movable frame 336 that lifts the movable frame 336 together with the rod 360.

Therefore, after the entire filling chamber 72, which is in the initial state depicted in FIG. 10 (the plunger 10 is located at its lowermost position), is filled with the viscous material 14, and when the volume of the filling chamber 72 further increases, it is thereby possible to raise the plunger 10, the rod 360 and the movable frame 336 without increasing much the pressure of the viscous material 14 within the filling chamber 72.

In other words, in step S27, the lifting of the rod 360 and the movable frame 336 is mechanically assisted by the gas spring 152.

Thereafter, in step S28, it is waited for the amount of the viscous material 14 that has filled into the cylinder 18 to reach a prescribed value, and for the rod 360 to rise up to a prescribed position. If the rod 360 rises up to the prescribed position, then the air cylinder 320 makes a shift to stop further advance of the pusher piston 122, which is followed by an action in which the air cylinder 332 extends the vertically-movable rod 342, thereby lifting the rod 360 with the plunger 10 remaining in the cartridge 12, and retracting the rod 360 from the cartridge 12.

Subsequently, in step S29, the operator removes the cartridge 12 from the container 112 and the filling device 210.

Thereafter, in step S30, the operator removes the container set from the filling device 210.

Then, the transferring and filling of the viscous material 14 from one unit of the container 112 to one unit of the cartridge 12 is completed.

Next, a plunger 10 according to an illustrative second embodiment of the present invention will be described. The present embodiment, however, will be described in detail with regard to only the elements that differ from those of the first embodiment, while a redundant description of the elements common with those of the first embodiment will be omitted by citing the common elements using the same names or reference numerals.

Figure 12A:
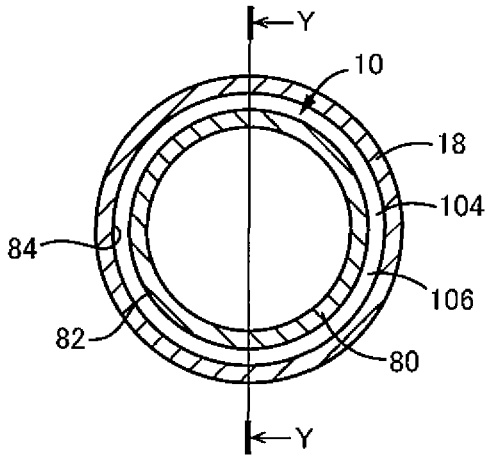
FIG. 12A is a cross-sectional view illustrating a relevant portion of a cartridge using a plunger according to an illustrative second embodiment of the invention.
Figure 12B:
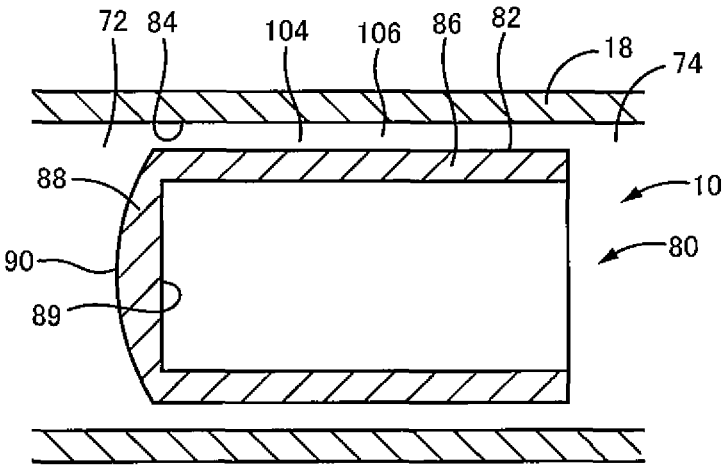
FIG. 12B is a cross-sectional side view taken along line Y-Y in FIG. 12A.

FIG. 12A is a cross-sectional view illustrating a relevant portion of a cartridge 12 using the plunger 10 according to the second embodiment, and FIG. 12B is a cross-sectional side view taken along line Y-Y in FIG. 12A.

In the present embodiment, similarly with the first embodiment, in a coaxially fitted state in which the plunger 10 is precisely coaxially fitted into the cylinder 18, a tubular clearance, which serves as a continuous clearance 106, is formed between the outer circumferential surface 82 of the main body portion 80 of the plunger 10 and the inner circumferential surface 84 of the cylinder 18 such that the tubular clearance continuously extends both in the axial and circumferential directions. By filling the continuous clearance 106 with a portion of the viscous material 14, a seal 104 forms.

As illustrated in FIG. 12A, in the present embodiment, in case the inner outline of the shape, which represents the cross section of the inner circumferential surface 84 of the cylinder 18, is a circle, the outer outline of the shape, which represents the cross section of the outer circumferential surface 82 of the plunger 10, is a smaller circle than the above-mentioned circle.

As a result, in the present embodiment, in case the plunger 10 is precisely concentrically fitted in the cylinder 18, the thickness of the continuous clearance 106 is uniform in the circumferential direction; however, when the axial center of the plunger 10 deviates from the axial center of the cylinder 18, the thickness of the continuous clearance 106 becomes non-uniform in the circumferential direction.

When the plunger 10 is fitted in the cylinder 18, the outer circumferential surface 82 creates a substantially circumferentially extending radial clearance vis-a-vis the inner circumferential surface 84 of the cylinder 18. In the present embodiment, differently from the first embodiment, no ridge 100 is formed on the outer circumferential surface 82.

The dimensions of the radial clearance are set to vary between a lower limit, which is necessary to allow the plunger 10 to be fitted into the cylinder 18 in an axially slidable manner without substantial play, and an upper limit, which is necessary, in a substantially final stage of a discharging phase in which the viscous material 14 is discharged from the filling chamber 72 to the outside, to allow the continuous clearance 106 to be substantially entirely filled with a portion of the viscous material 14 both in the circumferential and axial directions of the continuous clearance 106.

In one example, the dimensions of the radial clearance are set to vary within a range between 0.25 mm and 0.75 mm.

When the viscous material 14 is filled into the filling chamber 72 from the outside, the continuous clearance 106 is filled with a portion of the viscous material 14, thereby forming the seal 104. Said portion of the viscous material 14 blocks the rest of the viscous material 14 from leaking from the filling chamber 72 into the pressurizing chamber 74.

As will be understood from the foregoing, according to the present embodiment, the continuous clearance 106 is created between the outer circumferential surface 82 of the plunger 10 and the inner circumferential surface 84 of the cylinder 18, thereby making the outer diameter of the outer circumferential surface 82 smaller than the inner diameter of the inner circumferential surface 84 by a larger factor than in cases in which the above-described circumferential lands are used.

As a result, simultaneously contactable regions of the outer circumferential surface 82 of the plunger 10, for which there is a possibility of simultaneously contacting with the inner circumferential surface 84 of the cylinder 18 at each moment of time (e.g., the total area of the simultaneously contactable regions over the total length of the outer circumferential surface, or otherwise the total circumferential length of a curve obtained by virtually transversely cutting the simultaneously contactable regions of the outer circumferential surface at a particular axial position), decrease more than in cases in which the above-described circumferential lands are used.

The reduction of the simultaneously contactable regions allows the resistance to axially sliding movements of the plunger relative to the cylinder to decrease more than in cases in which the above-described circumferential lands are used. Thereby, in the discharging phase of the viscous material 14 from the pneumatic dispenser 20, the plunger 10 is caused to slide more smoothly when actuated by the pressurized gas than in cases in which the above-described circumferential lands are used.

As a result, even if the aforementioned tilting moment unintentionally occurs on the plunger 10 when the pressurized gas acts on the plunger, the plunger 10 tilts relative to the cylinder 18, and the plunger 10 locally contacts the cylinder 18, the risk of the plunger 10 being stuck at the same axial position is reduced. That is, the phenomenon of the plunger 10 being frequently unintentionally stuck in the cylinder 18 due to tilting of the plunger 10 is prevented.

As illustrated in FIG. 12A, in the present embodiment, in case the inner outline of the shape, which represents the cross section of the inner circumferential surface 84 of the cylinder 18, is a circle, the outer outline of the shape, which represents the cross section of the outer circumferential surface 82 of the plunger 10, is similarly a circle.

The present invention, however, may be embodied in other forms; for example, it may be embodied such that the continuous clearance 106, which continuously extends both axially and circumferentially, is created between the outer circumferential surface 82 of the plunger 10 and the inner circumferential surface 84 of the cylinder 18, as long as the continuous clearance 106 can be entirely filled with the viscous material 14, regardless of the cross sectional shape of the outer circumferential surface 82 of the plunger 10; for example, the present invention may be embodied as a land extending circumferentially on the outer circumferential surface 82 in the state in which a tip end surface of the land does not contact the inner circumferential surface 84 of the cylinder 18 in the concentrically fitted state.

Similarly with other embodiments, in the present embodiment, the plunger 10 is more loosely fitted in the cylinder 18 than before while creating a gap larger than before, without using any dedicated sealing member such as a packing or a ring exclusively intended for sealing the space between the plunger 10 and the cylinder 18. Further, the continuous clearance 106 resulting from the loose fitting is filled with the viscous material 14, and this sealed portion functions as a sealing member.

In other words, in the present embodiment, to omit the above-mentioned sealing member or a sealing fluid, the plunger 10 is more loosely fitted in the cylinder 14 than before, and the continuous clearance 106 resulting from the loose fitting realizes the sealing function by being filled with the viscous material 14.

Next, a plunger 10 according to an illustrative third embodiment of the present invention will be described. The present embodiment, however, will be described in detail with regard to only the elements that differ from those of the second embodiment, while a redundant description of the elements common with those of the second embodiment will be omitted by citing the common elements using the same names or reference numerals.

As illustrated in FIG. 12A, in the second embodiment, in case the inner outline of the shape, which represents the cross section of the inner circumferential surface 84 of the cylinder 18, is a circle, the outer outline of the shape, which represents the cross section of the outer circumferential surface 82 of the plunger 10, is similarly a circle.

In contrast thereto, as illustrated in FIG. 13, in the present embodiment, in case the inner outline of the shape, which represents the cross section of the inner circumferential surface 84 of the cylinder 18, is a circle, the outer outline of the shape, which represents the cross section of the outer circumferential surface 82 of the plunger 10, is a non-circular endless line.

As a result, in the present embodiment, unlike the case in which the outer outline of the shape, which represents the cross section of the outer circumferential surface 82 of the plunger 10, is a circle, irrespective of whether the plunger 10 has been fitted in the cylinder 18 in a precisely coaxial manner, the thickness of the continuous clearance 106 becomes non-uniform in the circumferential direction, and is thus uneven. As a result, a clearance, which is larger than in case the outer outline of the shape that represents the cross section of the outer circumferential surface 82 of the plunger 10 is a circle, is easily ensured between the plunger 10 and the cylinder 18, despite the clearance not being uniform in the circumferential direction.

Figure 13A:
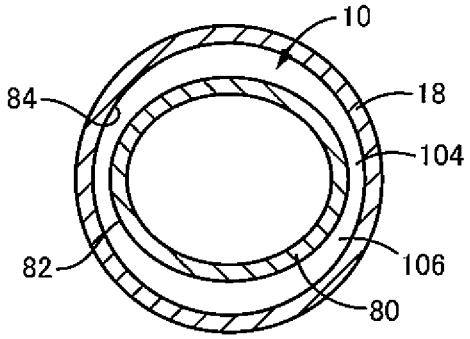
FIG. 13A is a cross-sectional view illustrating a relevant portion of a cartridge using an example of a plunger according to an illustrative third embodiment of the invention.

In one example, as illustrated in FIG. 13A, the outer outline of the shape, which represents the cross section of the outer circumferential surface 82 of the plunger 10, is an endless curved line, e.g., an ellipse, an oval, etc. In this example, it is possible to consider that a plurality of protrusions of the endless curved line (in case it is assumed that one circle circumscribes the endless curved line, a plurality of segments containing a plurality of contacts between the endless curved line and this circumscribed circle) constitute another example of the ridges 100.

Figure 13B:
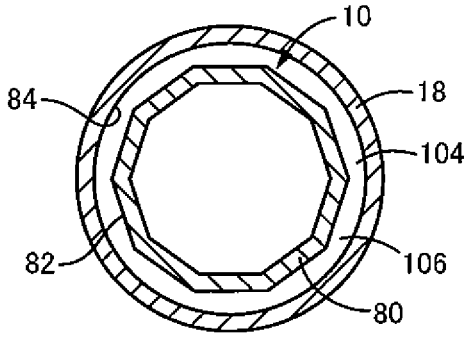
FIG. 13B is a cross-sectional view illustrating a relevant portion of a cartridge using another example of the plunger according to the third embodiment.

In another example, as illustrated in FIG. 13B, the outer outline of the shape, which represents the cross section of the outer circumferential surface 82 of the plunger 10, is a polygon (whether the endless curved line approximating the polygon is a circle or not). In this example, it is possible to consider that a plurality of protrusions of the polygon (in case it is assumed that one circle circumscribes the polygon, a plurality of segments containing a plurality of contacts between the polygon and this circumscribed circle) constitute another example of the ridges 100.

The present specification provides a complete description of the compositions of matter, methodologies, systems and/or structures and uses in exemplary implementations of the presently-described technology. Although various implementations of this technology have been described above with a certain degree of particularity, or with reference to one or more individual implementations, those skilled in the art could make numerous alterations to the disclosed implementations without departing from the spirit or scope of the technology thereof. Furthermore, it should be understood that any operations may be performed in any order, unless explicitly claimed otherwise or a specific order is inherently necessitated by the claim language. It is intended that all matter contained in the above description and shown in the accompanying drawings shall be interpreted as illustrative only of particular implementations and are not limiting to the embodiments shown. Changes in detail or structure may be made without departing from the basic elements of the present technology as defined in the following claims.

The invention claimed is:

1. A cartridge comprising:

a cylinder of a pneumatic dispenser that employs pressurized air to discharge a viscous material, the cylinder having a circular-shaped inner circumferential surface, a first end and a second end, and a discharge port at the first end configured to discharge the viscous material from the cylinder, and a plunger disposed within the cylinder and configured to divide an inner chamber of the cylinder into a filling chamber between the plunger and the first end, into which the viscous material is filled from the outside through the discharge port, and a pressurizing chamber between the plunger and the second end, into which the pressurized air is charged from the outside, the plunger comprising a substantially cylindrical main body portion that extends in an axial direction and has an outer circumferential surface;

wherein the outer circumferential surface of the plunger is shaped such that a radial tubular clearance is defined in a circumferential direction between the outer circumferential surface of the plunger and the inner circumferential surface of the cylinder, and such that the radial tubular clearance continuously extends between the outer circumferential surface of the plunger and the inner circumferential surface of the cylinder both in the axial and circumferential directions, the outer circumferential surface of the plunger is also shaped such that, when the viscous material is filled into the filling chamber from the outside through the discharge port, the continuous radial tubular clearance is filled with a portion of the viscous material, thereby forming a seal body made of said portion of the viscous material between the outer circumferential surface of the plunger and the inner circumferential surface of the cylinder, said seal body blocking further viscous material from leaking from the filling chamber into the pressurizing chamber, the outer circumferential surface of the plunger includes multiple ridges that each have a component that extends in the axial direction of the plunger, the multiple ridges being spaced apart from each other in the circumferential direction of the plunger, and each of the ridges is radially elastically deformable such that, when a tip end of the ridge is pressed against the inner circumferential surface of the cylinder, the tip end elastically deforms radially inwardly to prevent the ridge from strongly contacting the inner circumferential surface.

2. The cartridge according to claim 1, wherein the outer circumferential surface of the plunger is also shaped such that the dimensions of the radial tubular clearance vary between a lower limit, which is necessary to allow the plunger to be fitted into the cylinder in an axially slidable manner without play, and an upper limit, which is necessary, in a substantially final stage of a discharging phase in which the viscous material is discharged from the filling chamber to the outside, to allow the continuous radial tubular clearance to be filled with a portion of the viscous material both in the circumferential and axial directions of the continuous radial tubular clearance.

3. The cartridge according to claim 1, wherein the outer circumferential surface of the plunger is further shaped such that:

in a filling phase in which the viscous material is filled into the filling chamber from the outside, a portion of the viscous material travels from the filling chamber into the continuous radial tubular clearance, thereby filling the continuous radial tubular clearance with said portion of the viscous material that serves as a fill viscous-material, in a filled state, the fluidity of the fill viscous-material within the continuous radial tubular clearance varies such that the fluidity is higher in the axial direction than in the circumferential direction, and the fill viscous-material is allowed to flow between a ridge region on the outer circumferential surface that is defined by the ridges, and a groove region on the outer circumferential surface that is not defined by the ridges, thereby facilitating the filling of the continuous radial tubular clearance with the fill viscous-material both in the axial and circumferential directions, in a fully-filled state in which the continuous radial tubular clearance is fully filled with the fill viscous-material, the fill viscous-material itself blocks the rest of the viscous material from leaking into the pressuring chamber, in a pre-fully-filled state prior to the fully-filled state, gasses existing in the filling chamber are allowed to vent, via a portion of the continuous radial tubular clearance that has not yet filled with the fill viscous-material, into the pressurizing chamber, and in a discharging phase in which, in the fully-filled state, the pressurized gas is introduced into the pressurizing chamber to discharge the viscous material from the filling chamber, the fill viscous-material blocks the pressurizing gas from leaking from the pressurizing chamber into the filling chamber.

4. The cartridge according to claim 1, wherein each of the ridges has a width dimension in the circumferential direction that is narrower than a width dimension in the circumferential direction of a groove that is located on the outer circumferential surface between two adjacent ones of the ridges.

5. The cartridge according to claim 1, wherein at least one of the ridges extends at least substantially along the entire axial length of the plunger.

6. The cartridge according to claim 1, wherein at least one of the ridges has a width dimension in the circumferential direction that increases in the axial direction from the filling chamber to the pressurizing chamber.

7. A cartridge comprising:

a cylinder of a pneumatic dispenser that employs pressurized air to discharge a viscous material, the cylinder having a circular-shaped inner circumferential surface, a first end and a second end, and a discharge port at the first end configured to discharge the viscous material from the cylinder; and a plunger disposed within the cylinder and configured to divide an inner chamber of the cylinder into a filling chamber between the plunger and the first end, into which the viscous material is filled from the outside through the discharge port, and a pressurizing chamber between the plunger and the second end, into which the pressurized air is charged from the outside, the plunger comprising a substantially cylindrical main body portion that extends in an axial direction and has an outer circumferential surface;

wherein the outer circumferential surface of the plunger is shaped such that a radial tubular clearance is defined in a circumferential direction between the outer circumferential surface of the plunger and the inner circumferential surface of the cylinder, and such that the radial tubular clearance continuously extends between the outer circumferential surface of the plunger and the inner circumferential surface of the cylinder both in the axial and circumferential directions, the outer circumferential surface of the plunger is also shaped such that, when the viscous material is filled into the filling chamber from the outside through the discharge port, the continuous radial tubular clearance is filled with a portion of the viscous material, thereby forming a seal body made of said portion of the viscous material between the outer circumferential surface of the plunger and the inner circumferential surface of the cylinder, said seal body blocking further viscous material from leaking from the filling chamber into the pressurizing chamber, the outer circumferential surface of the plunger includes multiple ridges that each have a component that extends in the axial direction of the plunger, the multiple ridges being spaced apart from each other in the circumferential direction of the plunger, and at least one of the ridges has a height dimension that increases in the axial direction from the filling chamber to the pressurizing chamber.

8. A cartridge comprising:

a cylinder of a pneumatic dispenser that employs pressurized air to discharge a viscous material, the cylinder having a circular-shaped inner circumferential surface, a first end and a second end, and a discharge port at the first end configured to discharge the viscous material from the cylinder; and a plunger disposed within the cylinder and configured to divide an inner chamber of the cylinder into a filling chamber between the plunger and the first end, into which the viscous material is filled from the outside through the discharge port, and a pressurizing chamber between the plunger and the second end, into which the pressurized air is charged from the outside, the plunger comprising a substantially cylindrical main body portion that extends in an axial direction and has an outer circumferential surface;

wherein the outer circumferential surface of the plunger is shaped such that a radial tubular clearance is defined in a circumferential direction between the outer circumferential surface of the plunger and the inner circumferential surface of the cylinder, and such that the radial tubular clearance continuously extends between the outer circumferential surface of the plunger and the inner circumferential surface of the cylinder both in the axial and circumferential directions, wherein the outer circumferential surface of the plunger is also shaped such that, when the viscous material is filled into the filling chamber from the outside through the discharge port, the continuous radial tubular clearance is filled with a portion of the viscous material, thereby forming a seal body made of said portion of the viscous material between the outer circumferential surface of the plunger and the inner circumferential surface of the cylinder, said seal body blocking further viscous material from leaking from the filling chamber into the pressurizing chamber, wherein the outer circumferential surface of the plunger includes multiple ridges that each have a component that extends in the axial direction of the plunger, the multiple ridges being spaced apart from each other in the circumferential direction of the plunger, and wherein at least one of the ridges is configured as multiple discrete ridge segments that are aligned in the axial direction and are spaced apart from each other in the axial direction.

9. The cartridge according to claim 1, wherein the outer circumferential surface of the plunger is a smooth surface that substantially does not have any unevenness, or is an uneven surface.

10. The cartridge according to claim 1, wherein the axial length of the plunger is greater than its diameter.

11. The cartridge according to claim 1, wherein the inner outline of the shape, which represents the cross section of the inner circumferential surface, is a circle, and the outer outline of the shape, which represents the cross section of the outer circumferential surface, is a non-circular endless line that circumscribes a smaller circle than said circle.

12. The cartridge according to claim 11, wherein, the non-circular endless line has a shape selected from the group consisting of an ellipse, an oval and a polygon.

13. A cartridge comprising:

a cylinder of a pneumatic dispenser that employs pressurized air to discharge a viscous material, the cylinder having a circular-shaped inner circumferential surface, a first end and a second end, and a discharge port at the first end configured to discharge the viscous material from the cylinder; and a plunger disposed within the cylinder and configured to divide an inner chamber of the cylinder into a filling chamber between the plunger and the first end, into which the viscous material is filled from the outside through the discharge port, and a pressurizing chamber between the plunger and the second end, into which the pressurized air is charged from the outside, the plunger comprising a substantially cylindrical main body portion that extends in an axial direction and has an outer circumferential surface;

wherein:

the outer circumferential surface of the plunger is shaped such that a radial tubular clearance is defined in a circumferential direction between the outer circumferential surface of the plunger and the inner circumferential surface of the cylinder, and such that the radial tubular clearance continuously extends between the outer circumferential surface of the plunger and the inner circumferential surface of the cylinder both in the axial and circumferential directions;

the outer circumferential surface of the plunger is also shaped such that, when the viscous material is filled into the filling chamber from the outside through the discharge port, the continuous radial tubular clearance is filled with a portion of the viscous material, thereby forming a seal body made of said portion of the viscous material between the outer circumferential surface of the plunger and the inner circumferential surface of the cylinder, said seal body blocking further viscous material from leaking from the filling chamber into the pressurizing chamber;

the outer circumferential surface of the plunger includes multiple ridges that each have a component that extends in the axial direction of the plunger, the multiple ridges being spaced apart from each other in the circumferential direction of the plunger;

each of the ridges has a height dimension in a radial direction of the plunger that increases in the axial direction from the filling chamber to the pressurizing chamber such that tip ends of the ridges are disposed more closely to the inner circumferential surface of the cylinder near the pressurizing chamber than near the filling chamber; and each of the ridges extends at least substantially along the entire axial length of the plunger.

14. The cartridge according to claim 13, wherein the tip ends of the ridges are radially elastically deformable such that, when the tip ends are pressed against the inner circumferential surface of the cylinder, the tip ends elastically deform radially inwardly.

15. The cartridge according to claim 14, wherein the cylinder has a discharge nozzle detachably attached to a narrow tubular portion located at a distal tip end of the cylinder that forms a part of the filling chamber, said narrow tubular portion of the cylinder having a diameter that is less than the diameter of the portion of the cylinder surrounding the plunger.

16. The cartridge according to claim 15, wherein the cylinder and plunger are configured to both fill the cylinder with the viscous material and extrude the viscous material via the narrow tubular portion.

17. A method of using the cartridge of claim 15, comprising:

filling the cylinder with viscous material via the narrow tubular portion; and then extruding from the cylinder via the narrow tubular portion.

18. A cartridge comprising:

a cylinder of a dispenser configured to discharge a viscous material, the cylinder having a circular-shaped inner circumferential surface, a first end and a second end, and a discharge port disposed at the first end configured to discharge the viscous material from the cylinder, and a plunger disposed within the cylinder and configured to divide an inner chamber of the cylinder into an anterior chamber between the plunger and the first end, into which the viscous material is filled from the outside through the discharge port, and a posterior chamber opposite the anterior chamber between the plunger and the second end, the plunger comprising a substantially cylindrical main body portion that extends in an axial direction and has an outer circumferential surface;

wherein the outer circumferential surface of the plunger is shaped such that a radial tubular clearance is defined in a circumferential direction between the outer circumferential surface of the plunger and the inner circumferential surface of the cylinder, and such that the radial tubular clearance continuously extends between the outer circumferential surface of the plunger and the inner circumferential surface of the cylinder both in the axial and circumferential directions, the outer circumferential surface of the plunger is also shaped such that, when the viscous material is filled into the anterior chamber from the outside through the discharge port, the radial tubular clearance is filled with a portion of the viscous material, thereby forming a seal body made of said portion of the viscous material between the outer circumferential surface of the plunger and the inner circumferential surface of the cylinder, said seal body blocking further viscous material from leaking from the anterior chamber into the posterior chamber, wherein the outer circumferential surface of the plunger includes multiple ridges that each extend in a direction at least having at least a direction extending in parallel in the axial direction of the plunger and that are spaced apart from each other in the circumferential direction of the plunger, and wherein each of the ridges is radially elastically deformable such that, when a tip end of the ridge is pressed against the inner circumferential surface of the cylinder, the tip end elastically deforms radially inwardly to prevent the ridge from strongly contacting the inner circumferential surface.

* * * * *